US011294311B2

(12) United States Patent
Nojima et al.

(10) Patent No.: US 11,294,311 B2
(45) Date of Patent: Apr. 5, 2022

(54) IMAGE FORMING APPARATUS WITH COLLECTION OF DUST RESULTING FROM A PARTING AGENT CONTAINED IN TONER

(71) Applicant: Canon Kabushiki Kaisha, Tokyo (JP)

(72) Inventors: Koji Nojima, Chiba (JP); Kota Aoki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/077,422

(22) Filed: Oct. 22, 2020

(65) Prior Publication Data

US 2021/0055678 A1 Feb. 25, 2021

Related U.S. Application Data

(63) Continuation of application No. PCT/JP2019/018651, filed on Apr. 25, 2019.

(30) Foreign Application Priority Data

Apr. 26, 2018 (JP) ..... JP2018-084970

(51) Int. Cl.
*G03G 15/20* (2006.01)
*G03G 21/20* (2006.01)

(52) U.S. Cl.
CPC ..... *G03G 15/2039* (2013.01); *G03G 15/2017* (2013.01); *G03G 21/206* (2013.01)

(58) Field of Classification Search
CPC ..... G03G 15/2039; G03G 15/2017; G03G 21/206
USPC ..... 399/67, 69, 92, 93, 98
See application file for complete search history.

(56) References Cited

U.S. PATENT DOCUMENTS

| | | | | |
|---|---|---|---|---|
| 7,589,300 | B2 | 9/2009 | Nojima | 219/619 |
| 8,139,995 | B1 | 3/2012 | Fujita et al. | 399/390 |
| 9,152,097 | B2 | 10/2015 | Nojima et al. | G03G 15/2017 |
| 9,188,951 | B2 | 11/2015 | Nojima | G03G 15/2025 |

(Continued)

FOREIGN PATENT DOCUMENTS

| | | |
|---|---|---|
| JP | 2011180236 A | 9/2011 |
| JP | 2014044238 A | 3/2014 |

(Continued)

OTHER PUBLICATIONS

International Search Report, dated Jul. 2, 2019, in International Application No. PCT/JP2019/018651.

(Continued)

*Primary Examiner* — William J Royer
(74) *Attorney, Agent, or Firm* — Venable LLP

(57) ABSTRACT

A printer 1 including an image forming portion using toner containing a wax, a transfer portion for transferring an image onto a sheet, a belt unit and a pressing roller which heat the sheet in a nip, a duct including an air suction port for sucking air from a sheet inlet, a filter provided on the duct and for collecting dust, and a fan provided on the duct and for sucking the air includes a detector for detecting a temperature in the neighborhood of the belt unit and a control circuit portion for effecting control so that an air flow rate of the fan is weakened in the case where the temperature in the neighborhood of the belt unit is high during an image forming process and so that the air flow rate of the fan is weakened in the case where the temperature is high.

18 Claims, 16 Drawing Sheets

(56) References Cited

U.S. PATENT DOCUMENTS

| | | | | |
|---|---|---|---|---|
| 9,250,578 | B2 | 2/2016 | Aoki | G03G 21/1619 |
| 9,383,696 | B2 | 7/2016 | Nojima et al. | G03G 1/2017 |
| 9,411,275 | B2 | 8/2016 | Sugiyama et al. | G03G 15/2028 |
| 9,465,360 | B2 | 10/2016 | Aoki et al. | G03G 15/2017 |
| 9,501,008 | B2 | 11/2016 | Nojima et al. | G03G 15/2053 |
| 10,191,417 | B2 | 1/2019 | Nojima et al. | G03G 15/2025 |
| 10,663,920 | B2 * | 5/2020 | Funaba | G03G 21/206 |
| 10,990,061 | B2 * | 4/2021 | Kawasumi | G03G 15/2017 |
| 2008/0038008 | A1 | 2/2008 | Fujita et al. | 399/92 |
| 2011/0211860 | A1 | 9/2011 | Shimoyama et al. | |
| 2013/0183061 | A1 | 7/2013 | Park et al. | |
| 2014/0056608 | A1 | 2/2014 | Miura | |
| 2015/0338799 | A1 | 11/2015 | Hamada | |
| 2018/0292782 | A1 | 10/2018 | Nojima | |

FOREIGN PATENT DOCUMENTS

| | | | |
|---|---|---|---|
| JP | 2015219432 | A | 12/2015 |
| JP | 2017120284 | A | 7/2017 |
| JP | 2017120404 | A | 7/2017 |
| JP | 2019020625 | A | 2/2019 |

OTHER PUBLICATIONS

Office Action dated Jan. 25, 2022 in counterpart Japanese Application No. 2018-084970, together with English translation thereof.

* cited by examiner (a)

(b)

(a)

(b)

IMAGE FORMING APPARATUS WITH COLLECTION OF DUST RESULTING FROM A PARTING AGENT CONTAINED IN TONER

CROSS-REFERENCE TO RELATED APPLICATIONS

This application is a continuation of International Patent Application No. PCT/JP2019/018651, filed Apr. 25, 2019, which claims the benefit of Japanese Patent Application No. 2018-084970, filed Apr. 26, 2018. The foregoing applications are incorporated herein by reference in their entireties.

TECHNICAL FIELD

The present invention relates to an image forming apparatus for forming an image of toner on a recording material. This image forming apparatus is used as a copying machine, a printer, a facsimile machine, and a multi-function machine having a plurality of functions of these.

BACKGROUND ART

The image forming apparatus of an electrophotographic type forms the image on the recording material by using the toner containing a parting agent (sometimes known as a "releasing agent" or "wax releasing agent"). Further, the image forming apparatus includes a fixing device for fixing the image on the recording material by heating and pressing the recording material carrying the toner image thereon.

In a fixing device described in Japanese Laid-Open Patent Application (JP-A) 2017-120284, a nip is formed between a fixing roller and a pressing roller, and the recording material is passed through this nip and thus the toner image is fixed on the recording material.

Further, the image forming apparatus described in JP-A 2017-120284 includes a constitution for collecting dust generated by heating of the toner containing the parting agent. Specifically, this image forming apparatus is provided with an opening of a duct at a position where the image forming apparatus opposes the fixing roller, and this opening extends along a longitudinal direction of the fixing roller. This duct is connected to an air discharging passage including a fan and guides the air in the neighborhood of a fixing belt to the air discharging passage. In the air discharging passage, a filter such as an electrostatic filter is provided, and removes the dust contained in the air.

In such an apparatus, it has been required that dust removing power is maintained over a long term.

SUMMARY OF THE INVENTION

Problem to be Solved by the Invention

The present invention aims at providing an image forming apparatus of which dust removing power is maintained over a long term.

Means for Solving the Problem

According to an aspect of the present invention, there is provided an image forming apparatus comprising: an image forming portion for forming a toner image on a recording material at a first position by using toner containing a parting agent; a fixing portion for fixing an unfixed toner image, at a second position, formed on the recording material by the image forming portion; a heat discharging duct, including an inlet between the first position and the second position with respect to a recording material feeding direction, for discharging air heated by the fixing portion; a heat discharging fan for generating an air flow in the heat discharging duct; a collecting duct, including an inlet between the first position and the second position with respect to the recording material feeding direction, for collecting particles with a predetermined particle size resulting from the parting agent; a collecting fan for generating an air flow in the collecting duct; and a controller for controlling operations of the heat discharging fan and the collecting fan, wherein the controller actuates the collecting fan while stopping the operation of the heat discharging fan when a temperature in a neighborhood of the fixing portion is a first temperature, and actuates the heat discharging fan while stopping the operation of the collecting fan when the temperature in the neighborhood of the fixing portion is a second temperature higher than the first temperature.

According to another aspect of the present invention, there is provided an image forming apparatus comprising: an image forming portion for forming a toner image on a recording material at a first position by using toner containing a parting agent; a fixing portion including a rotatable heating member and a rotatable region member that fix the toner image, at a second position, fed from the first position by nipping and feeding the recording material through heat and pressure; a duct provided with an air suction port between the first position and the second position; a filter, provided on the duct, for collecting dust resulting from the parting agent; a fan for generating an air flow for sucking air into the duct; temperature detecting means for detecting a spatial temperature in a neighborhood of the rotatable heating member; and a controller for controlling an operation of the fan, wherein, when a surface temperature of the rotatable heating member is Tb (° C.), a dust generation temperature of the toner in Tws (° C.), and the spatial temperature detected by the temperature detecting means is Ta (° C.), the controller actuates the fan at a predetermined first efficiency when the following condition formulas (A) and (B) are satisfied, and causes the fan to be in a non-actuation state or actuates the fan at a predetermined second efficiency lower in efficiency than the first efficiency in a case that the following condition formulas are not satisfied:

$$Tb \geq Tws - Z \qquad \text{formula (A)},$$

where Z is a peripheral adjusting temperature value (° C.), and $$Tws - Ta > \text{first temperature} \qquad \text{formula (B)},$$

where the first temperature is a peripheral threshold temperature.

According to a further aspect of the present invention, there is provided an image forming apparatus comprising: an image forming portion for forming a toner image on a recording material at a first position by using toner containing a parting agent; a fixing portion including a rotatable heating member and a rotatable region member that fix the toner image, at a second position, fed from the first position by nipping and feeding the recording material through heat and pressure; a cooling duct provided with an air suction port between the first position and the second position; a cooling fan for generating an air flow for sucking air into the cooling duct; temperature detecting means for detecting a spatial temperature in a neighborhood of the rotatable heating member; and a controller for controlling an operation of the cooling fan, wherein, when a surface temperature of the rotatable heating member is Tb (° C.), a dust generation temperature of the toner is Tws (° C.), and the spatial temperature detected by the temperature detecting means is Ta (° C.), the controller causes the cooling fan to be in a non-actuation state or actuates the cooling fan at a predetermined second efficiency lower in efficiency than a first efficiency in a case that the following condition formulas are satisfied:

$$Tb \geq Tws - Z \quad \text{formula (A)},$$

where Z is a peripheral adjusting temperature value (° C.), and $$Tws - Ta > \text{first temperature} \quad \text{formula (B)},$$

where the first temperature is a peripheral threshold temperature.

EMBODIMENTS FOR CARRYING OUT THE INVENTION

In the following, the present invention will be specifically described using embodiments. Incidentally, unless otherwise specified, within a concept of the present invention, various constitutions described in an embodiment may also be replaced with other known constitutions.

Embodiment 1

(1) General Structure of Image Forming Apparatus

Figure 4:
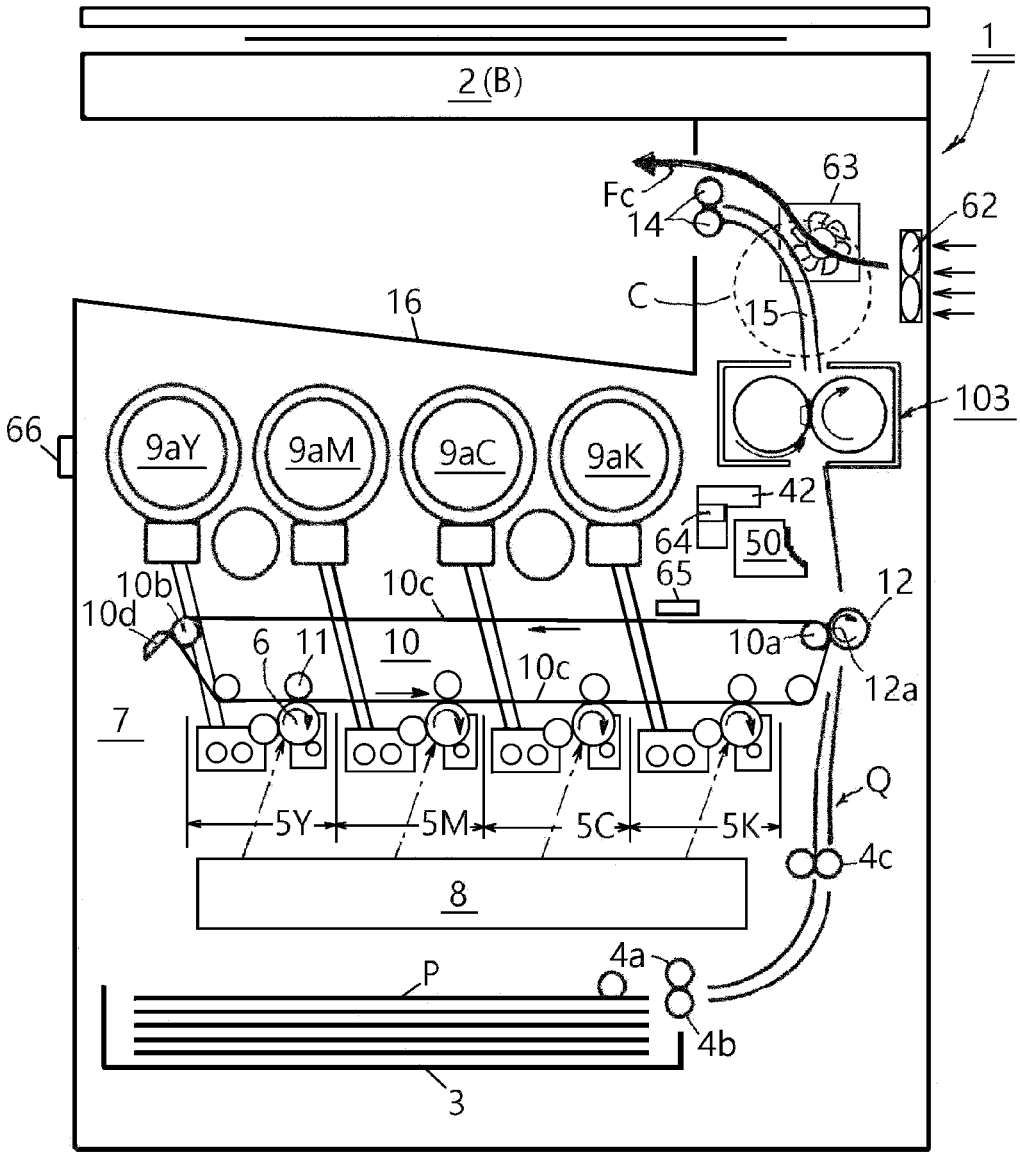
FIG. 4 is a view showing a structure of the image forming apparatus of the embodiment 1.
Figure 12:
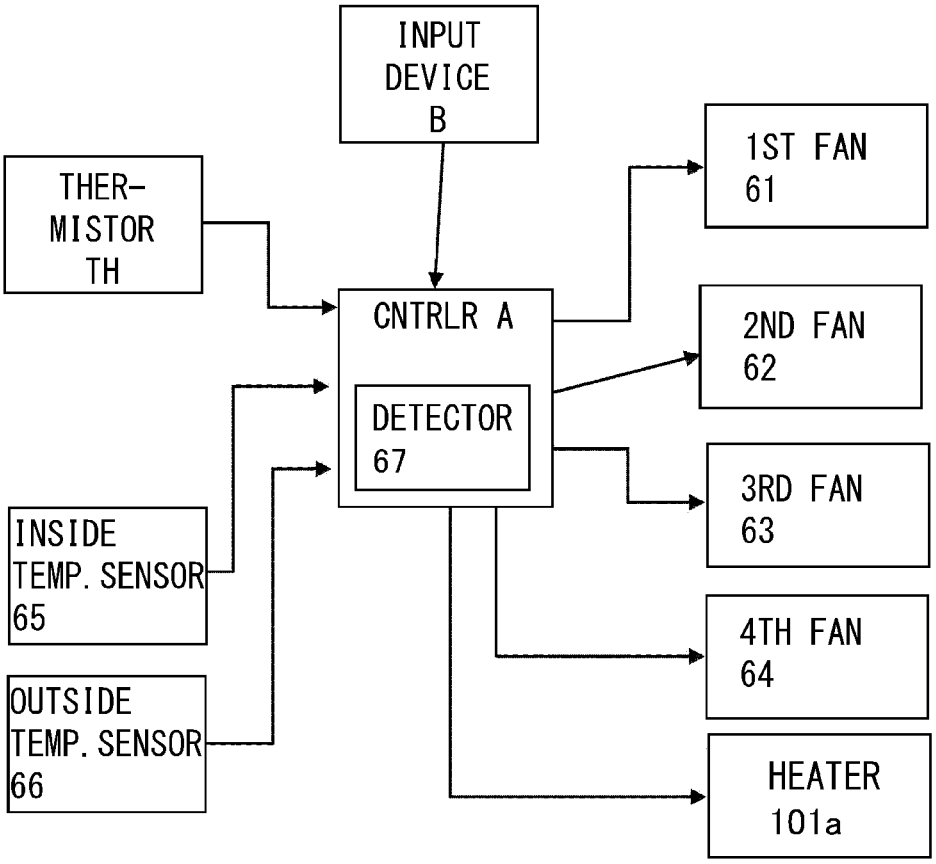
FIG. 12 is a view showing connection between a control circuit and each of constituent elements.

Before a characteristic (feature) portion of this embodiment is described, a general structure of an example of an image forming apparatus 1 will be described. FIG. 4 is a schematic view showing a structure of the image forming apparatus (hereinafter referred to as a printer) 1 in this embodiment. FIG. 12 is a block diagram showing a relationship between a control circuit and each of constituent elements.

The printer 1 forms an image (unfixed toner image) by an image forming portion 7 using an electrophotographic process and transfers this image onto a recording material P at a transfer portion 12*a*. The recording material P is a recording medium on which the image is to be formed at a surface thereof. As an example of the recording material P, it is possible to cite plain paper, thick paper, an OHP sheet, coated paper, label paper, or the like. In the following, the recording material is referred to as a sheet or is also referred to as a paper or form. The sheet P on which the image is transferred is heated at a fixing portion 103, so that the image is fixed on the sheet P.

The printer 1 used in description of this embodiment is a four-color-based full-color multi-function printer (color image forming apparatus) using the electrophotographic process. Incidentally, the printer 1 may also be a monochromatic multi-function printer or a single-function printer. In the following, the printer 1 will be specifically described using the drawings.

The printer 1 includes a control circuit portion (CNTRLR) A (FIG. 12) for controlling respective constitutions (constituent elements) in the apparatus. The control circuit portion A is an electric circuit including an operation portion such as a CPV and a storing portion such as a ROM. The control circuit portion A functions as a controller for carrying out various pieces of control by reading a program, stored in the ROM or the like, by the CPU.

The control circuit portion A is electrically connected to various constituent elements including an input device B including external information terminal (not shown) such as a personal computer and an image reader 2, and an operating panel (not shown), and the like, and is capable of transferring signal information therebetween. The control circuit portion A carries out integrated control of the respective constituent elements in the apparatus on the basis of an image signal inputted from the input device B.

Further, the control circuit portion A includes a temperature detecting means (DETECTOR) 67 for detecting a temperature of the neighborhood of a fixing belt 105 (rotatable heating member) described later in FIG. 5.

As shown in FIG. 4, the printer 1 includes first to fourth image forming stations 5Y, 5M, 5C and 5K (hereinafter referred to as station(s)) as the image forming portion 7 for forming a toner image. The stations 5Y, 5M, 5C and 5K are provided and arranged from a left-hand side toward a right-hand side as shown in FIG. 4.

The stations 5Y, 5M, 5C and 5K are constituted substantially similar to each other except that colors of toners used are different from each other. For that reason, in the case where detailed structures of the stations 5Y, 5M, 5C and 5K are described, a first station 5Y will be described as a representative example.

The first station 5Y includes a rotation drum-type electrophotographic photosensitive member (hereinafter referred to as a drum) 6 as an image bearing member on which the image is to be formed. Further, the first station 5Y includes, as process means actable on this drum 6, a cleaning member (not shown), a developing unit (unnumbered, to the left of drum 6 in the perspective of FIG. 4), and a charging roller (unnumbered, to the right of drum 6 in the perspective of FIG. 4). Addition of reference numerals to the corresponding elements in the stations 5M, 5C and 5K other than this first station 5Y is omitted.

The first station 5Y accommodates a developer (hereinafter referred to as toner) of the color of yellow (Y) in a toner accommodating chamber of the developing unit. The second station 5M accommodates toner of the color of magenta (M) in a toner accommodating chamber of the developing unit. The third station 5C accommodates toner of the color of cyan (C) in a toner accommodating chamber of the developing unit. The fourth station 5K accommodates toner of the color of black (K) in a toner accommodating chamber of the developing unit. 9aY, 9aM, 9aC and 9aK are toner supplying mechanisms to the developing units in the stations 5Y, 5M, 5C and 5K, respectively.

On a side below the image forming portion 7, a laser scanner unit 8 as an image information exposure means for the drums 6 in the respective stations 5Y, 5M, 5C and 5K is provided. On an upper side of the image forming portion 7, an intermediary transfer belt unit 10 (hereinafter referred to as a transfer unit) is provided.

The transfer unit 10 includes an intermediary transfer belt (hereinafter referred to as a transfer belt) 10*c* and a driving roller 10*a* for driving the transfer unit 10. Further, first to fourth primary transfer rollers 11 corresponding to the respective stations 5Y, 5M, 5C and 5K are provided in parallel to each other inside the belt 10*c*. The respective primary transfer rollers 11 are provided opposed to the drums 6 of the respective stations. Upper surface portions of the drums 6 of the image forming portion 7 contact a lower surface of the belt 10*c* in positions of the primary transfer rollers 11. This contact portion is called a primary transfer portion.

The driving roller 10*a* is a roller for rotationally driving the belt 10*c*, and a secondary transfer roller 12 is provided outside a portion of the belt 10*c* backed up by the driving roller 10*a*. The belt 10*c* contacts the secondary transfer roller 12 which is a transfer means, and this contact portion is called a secondary transfer portion 12*a* (transfer portion: first position). Outside a portion of the belt 10*c* backed up by a tension roller 10*b*, a transfer belt cleaning device 10*d* is provided. At a portion below the laser scanner value 8, a cassette 3 for accommodating the sheets P is provided.

As shown in FIG. 4, the printer 1 is provided with a sheet feeding passage (vertical path) Q for feeding upward the sheet P picked up from the cassette 3. This sheet feeding passage Q is provided sequentially from a lower side to an upper side with a roller pair of a feeding roller 4*a* and a retard roller 4*b*, a registration roller pair 4*c*, the secondary transfer roller 12, a fixing device (fixing portion) 103 and a discharging roller pair 14. Further, at a portion below the image reader 2, a discharge tray 16 is provided.

An image forming sequence will be described. In the case where the printer 1 performs an image forming operation, a control circuit portion (control portion, controller) A carries out the following control. The control circuit portion A causes the drums 6 of the first to fourth stations 5Y, 5M, 5C and 5K to be rotationally driven at a predetermined speed in the clockwise direction in the figure in synchronism with image formation timing. The control circuit portion A controls drive of the driving roller 10*a* so that the transfer belt 10*c* is rotated normally at a speed depending on a rotational speed of the drum 6 in the rotational direction of the drum 6. Further, the control circuit portion A causes the laser scanner unit 8 and charging rollers (not shown) to be actuated.

The above-described control is carried out, so that the printer 1 forms a full-color image in the following manner. First, the charging rollers (not shown) electrically charge the surfaces of the drums 6 uniformly to a predetermined polarity and a predetermined potential. Next, the laser scanner unit 8 subjects the surfaces of the drums 6 to scanning exposure with laser beams modulated depending on image information signals of the respective colors of Y, M, C and K. Thus, on the surfaces of the respective drums 6, electrostatic latent images depending on the corresponding colors are formed. The formed electrostatic latent images are developed as toner images by the developing units.

The toner images of the respective colors of Y, M, C and K formed as described above are synthesized by being successively primary-transferred superposedly onto the transfer belt 10*c*. Thus, a full-color unfixed toner image obtained by synthesizing the toner images of the four colors of Y+M+C+K is formed on the transfer belt 10*c*. Then, this unfixed toner image is fed to the secondary transfer portion 12*a* (transfer portion) by rotation of the transfer belt 10*c*. The surfaces of the drums 6 after the toner images are primary-transferred onto the transfer belt 10*c* are cleaned by cleaning members.

On the other hand, the sheets P in the cassette 3 are fed correspondingly to one sheet by the feeding roller 4*a* and the retard roller 4*b* and are conveyed to the registration roller pair 4*c*. The registration roller pair 4*c* conveys the sheet P toward the secondary transfer portion 12*a* in synchronism with the toner image on the transfer belt 10*c*. To the secondary transfer roller 12, a secondary transfer bias of an opposite polarity to a normal charge polarity of the toner is applied. For that reason, when the sheet P is nipped and fed (conveyed) to the secondary transfer portion 12*a*, the four color toner images on the transfer belt 10*c* are collectively secondary-transferred onto the sheet P.

When the sheet P fed from the secondary transfer portion 12*a* is separated from the transfer belt 10*c* and is fed to the fixing device 103, the toner images are heat-fixed on the sheet P. The sheet P fed from the fixing device 103 passes through a guiding member 15 and the discharging roller pair 14 and is discharged onto the discharge tray 16. Transfer residual toner remaining on the surface of the transfer belt 10*c* after the toner image is secondary-transferred onto the sheet P is removed from the belt surface by the transfer belt cleaning device 10*d*.

Incidentally, at a peripheral portion of the fixing device 103, a plurality of fans and ducts for generating air flow are provided. When the sheet P containing water content is heated by the fixing device 103, in addition to heat generated from the fixing device 103, water vapor generates from the sheet P. By this water vapor, a space C on a side downstream of the fixing device 103 with respect to the sheet feeding direction is in a state in which humidity is high. When the humidity is high, there is a possibility that a water droplet generates on the guiding member 15. When the water droplet on the guiding member 15 deposits on the fed sheet P, an occurrence of image defect is caused.

For that reason, the printer 1 sucks air (outside air) from an outside of the printer 1 into an inside thereof by a second fan 62 and blows the air against the guiding member 15, and lowers the humidity of the space C. The water vapor discharged from the space C by air blowing from the second fan 62 is not only discharged toward the discharge tray 16 along an air flow (current) Fc but also discharged to the outside of the printer 1 along air flows 63*a* by a third fan 63 (see FIG. 2). The third fan 63 also has a function of discharging heat generated from the fixing device 103.

Here, in the following description, an upstream side and a downstream side are the upstream side and the downstream side with respect to a feeding direction X (see FIG. 1) of the sheet (recording material) P.

Further, the printer 1 includes a cooling duct 42 and a fourth fan (transfer portion cooling fan) 64 being a cooling suction portion, which discharge heat in a space on the side upstream of the fixing device 103, i.e., a space between the secondary transfer portion 12*a* being the transfer portion and the fixing device 103. Further, the printer 1 includes a filter unit 50 for collecting and removing dust D (FIG. 11 and the like: details are described later) generated on the side upstream of the fixing device 103.

Figure 2:
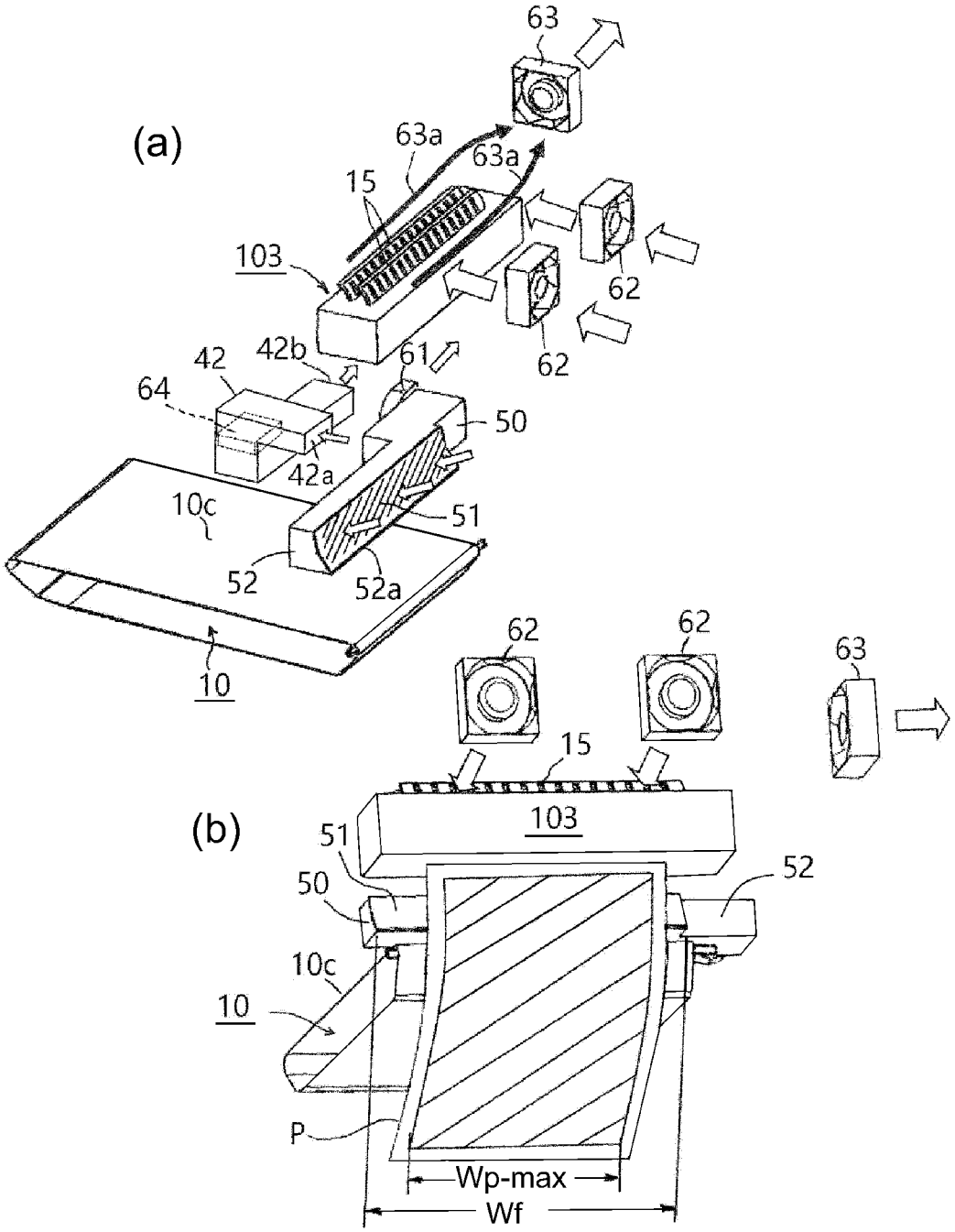
In FIG. 2, part (a) is a perspective view of arranged constituent elements of a fixing device at a peripheral portion of the fixing device, and part (b) is a view showing a passing position of a sheet (recording material) at the peripheral portion of the fixing device.
Figure 3:
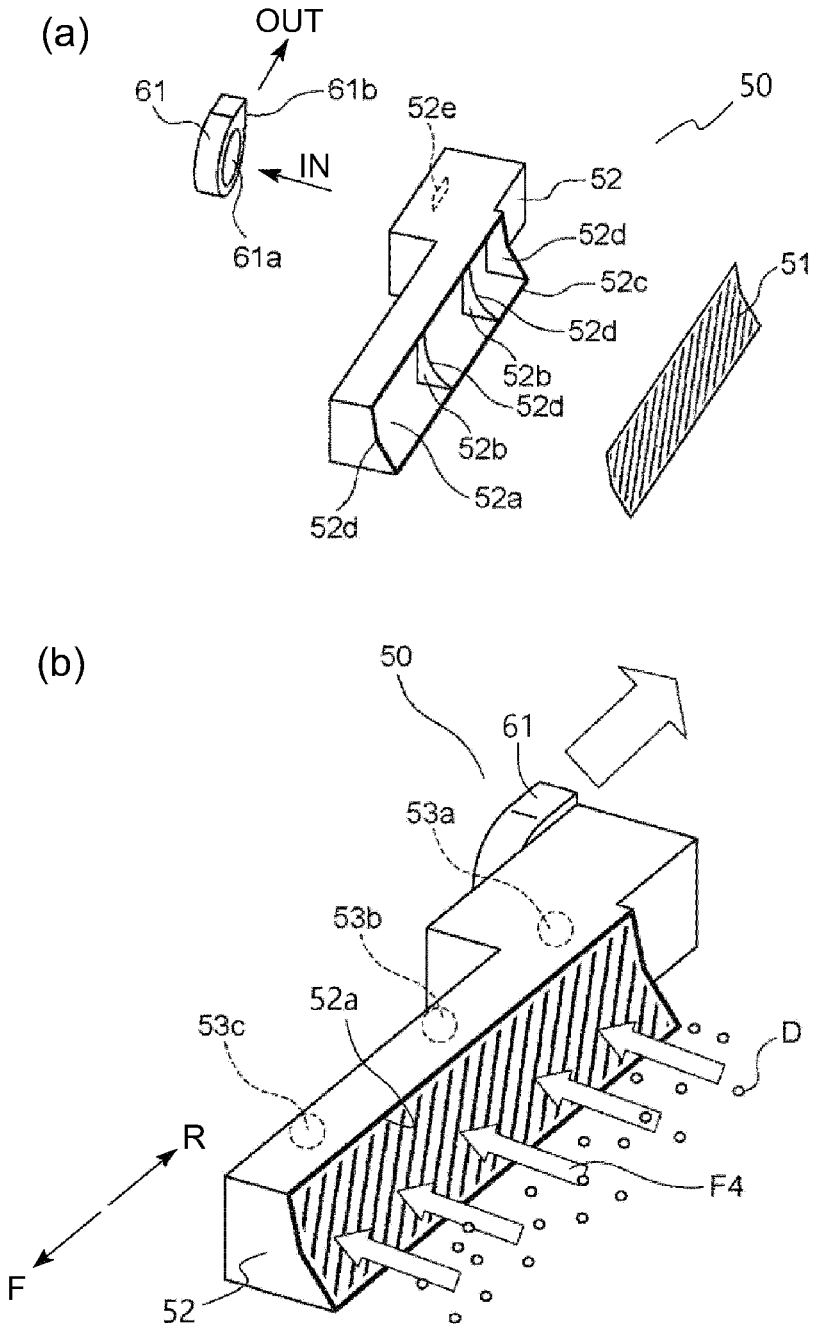
In FIG. 3, part (a) is an exploded perspective view of a duct unit, and part (b) is a view showing a state in which the duct unit operates.

The filter unit 50 includes a first fan (dust collecting fan) 61 which is a suction portion as shown in FIG. 2 and FIG. 3 and performs a function such that the air is taken in through a filter 51 mounted at an air suction port 52*a* and that the dust D is removed. Further, the printer 1 includes, for properly controlling the second fan 62, the third fan 63 and the fourth fan 64 which discharge heat and humidity, an in-body temperature sensor 65 for measuring an inside temperature of the printer 1 and an outside temperature sensor 66 for measuring an outside temperature of the printer 1.

(2) Fixing Device

Next, the fixing device 103 and the dust D generating in the neighborhood of the fixing device 103 will be described.

(2-1) Fixing Device 103

Figure 5:
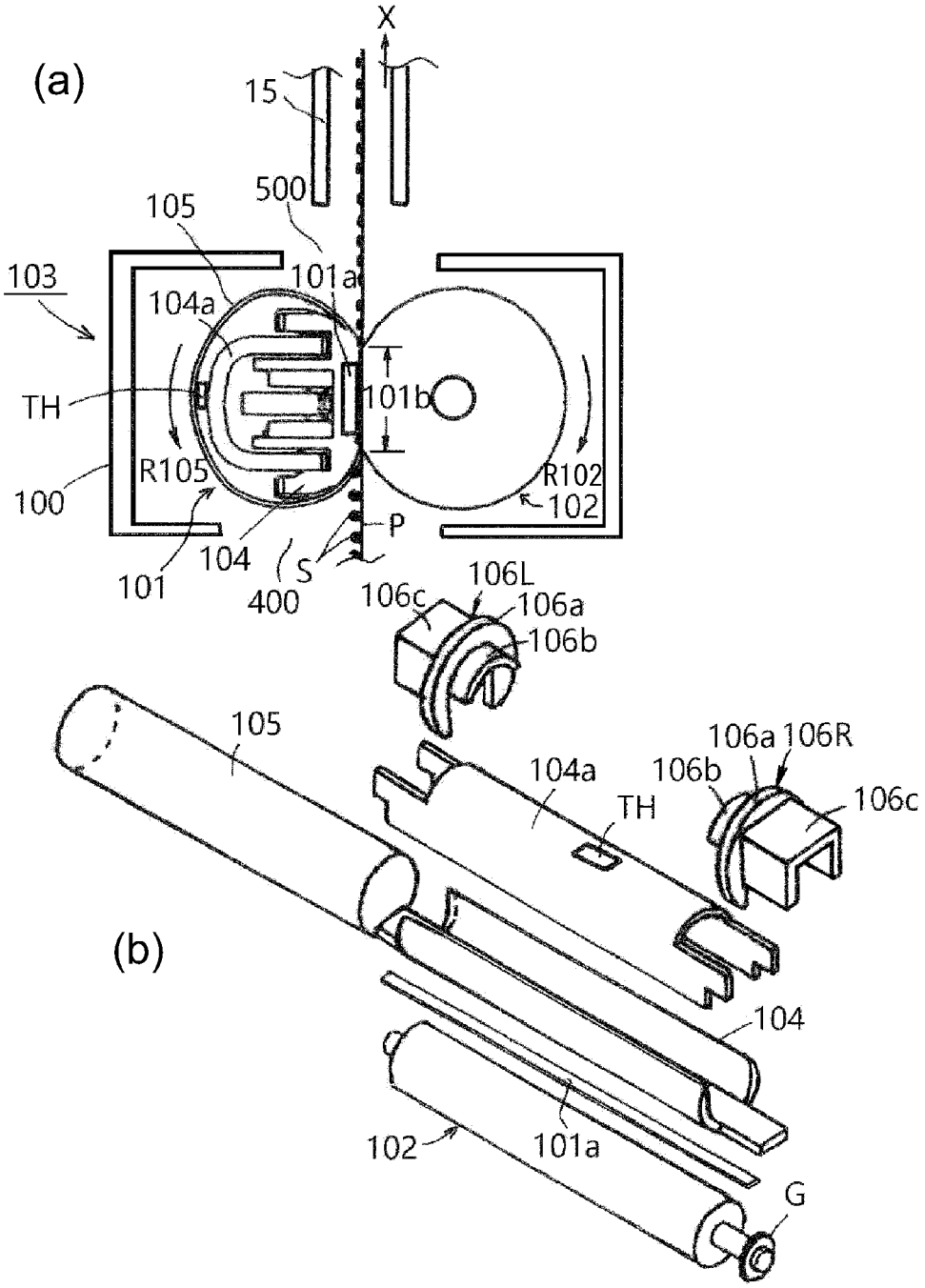
In FIG. 5, part (a) is a sectional view of the fixing device, and part (b) is an exploded perspective view of a belt unit.

Part (a) of FIG. 5 is a view showing a cross section of the fixing device 103. Part (b) of FIG. 5 is a view showing a state in which a fixing belt unit 101 is disassembled. The fixing device 103 in this embodiment is a fixing device with low thermal capacity in which the toner image is fixed on the sheet P by using a small-size fixing belt 105 (hereinafter referred to as a belt) heated by a heater 101*a*.

The fixing device 103 includes the fixing belt unit 101 (hereinafter referred to as a fixing unit) including the belt 105 as a rotatable heating member, a pressing roller 102 as a rotatable supporting member (predetermined pressing member), a planar heater 101*a* as a heating portion, and a casing 100.

As shown in part (a) of FIG. 5, the casing 100 is provided with a sheet inlet 400 and a sheet outlet 500. By this sheet inlet 400 and the sheet outlet 500, the sheet P can be passed through a nip (heating nip: second position) 101*b* formed therebetween in cooperation with the fixing unit 101 and the pressing roller 102 which are a pair of rotatable members.

In this embodiment, the sheet inlet 400 is disposed below the sheet outlet 500 with respect to a direction of gravitation, and therefore, the sheet P is fed from below toward above with respect to the direction of gravitation. This constitution is referred to as a vertical path constitution. On a side downstream of the sheet outlet 500, the guiding member 15 for generating feeding of the sheet P passed through the nip 101*b* is provided.

(2-2) Constitution of Fixing Unit 101

The fixing unit 101 is a unit such that the fixing unit 101 contacts the pressing roller 102 described later and forms the nip 101*b* between the belt 105 and the pressing roller 102, and fixes the toner image on the sheet P in the nip 101*b*.

The fixing unit 101 is an assembly constituted by a plurality of members as shown in part (a) of FIG. 5 and part (b) of FIG. 5. The fixing unit 101 includes the planar heater 101*a*, a heater holder 104 holding the heater 101*a*, and a pressing stay 104 supporting the heater holder 104*a*. Further, the fixing unit 101 includes the belt 105 and flanges 106L and 106R holding one end side and the other end side of the belt 105 with respect to a widthwise direction of the belt 105.

The heater 101*a* is a heating member for heating the belt 105 in contact with an inner surface of the belt 105. In this embodiment, as the heater 101*a*, a ceramic heater generating heat by energization is used. The ceramic heater includes an elongated thin ceramic substrate and a resistance layer provided on a surface of the substrate and is a low thermal capacity heater which quickly generates heat as a whole by energizing the resistance layer.

The heater holder 104 is a holding member for holding the heater 101*a*. The holder 104 in this embodiment has an arcuate shape in cross-section and regulates a shape of the belt 105 with respect to a circumferential direction. As a material of the holder 104, a heat-resistant resin (material) may desirably be used.

The pressing stay 104*a* is a member for pressing uniformly the heater 101*a* and the heater holder 104 against the belt 105 with respect to a longitudinal direction. The pressing stay 104*a* may desirably be a material which is not readily bent even when a high pressing force is applied thereto. In this embodiment, as the material of the pressing stay 104*a*, SUS304 which is stainless steel was used. On the pressing stay 104*a*, a thermistor TH is provided. The thermistor TH outputs, to the control circuit portion A, a signal depending on a temperature of the belt 105.

The belt 105 is a rotatable member for imparting heat to the sheet P in contact with the sheet P. The belt 105 is a cylindrical (endless) belt and has flexibility as a whole. The belt 105 is provided so as to cover the heater 101*a*, the heater holder 104 and the pressing stay 104*a* from an outside.

The flanges 106L and 106R are a pair of members for rotatably holding longitudinal end portions of the belt 105. Each of the flanges 106L and 106R includes, as shown in part (b) of FIG. 5, a flange portion 106*a*, a back-up portion 106*b* and a portion-to-be-pressed 106*c*.

The flange portion 106*a* is a portion for restricting movement of the belt 105 in a thrust direction of the belt 105 by receiving an end surface of the belt 105 and has an outer configuration larger than a diameter of the belt 105. The back-up portion 106*b* is a portion for holding a cylindrical shape of the belt 105 by holding an end portion inner surface of the belt 105. The portion-to-be-pressed 106*c* is provided on an outer surface side of the flange portion 106*a* and receives a pressing force by pressing springs 108L and 108R (see FIG. 7) described later.

(2-3) Constitution of Fixing Belt

Figure 6:
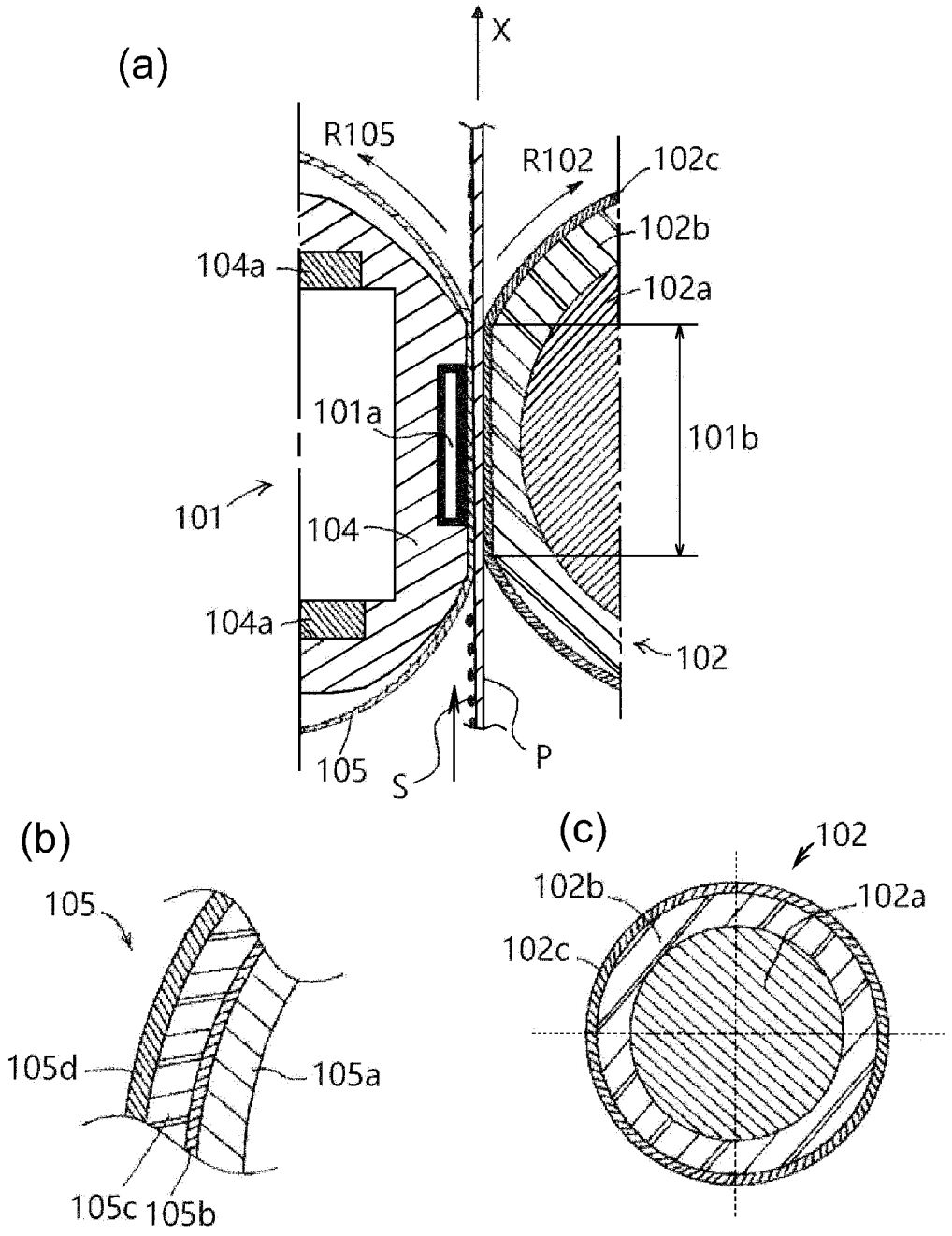
In FIG. 6, part (a) is a cross-sectional view of the fixing device in the neighborhood of a nip, part (b) is a view showing a layer structure of a fixing belt, and part (c) is a view showing a layer structure of a pressing roller.

Part (a) of FIG. 6 is an enlarged schematic sectional view of a neighborhood of the fixing nip 101*b*. Part (b) of FIG. 6 is a view showing a layer structure of the belt 105. Part (c) of FIG. 6 is a view showing a layer structure of the pressing roller 102.

The belt 105 in this embodiment is constituted by a plurality of layers. Specifically, the belt 105 sequentially includes, from an inside toward an outside, an endless (cylindrical) base layer 105*a*, a primer layer 105*b*, an elastic layer 105*c*, and a parting layer 105*d*.

The base layer 105*a* is a layer for ensuring strength of the belt 105. The base layer 105*a* is a base layer made of metal such as SUS (stainless) and has a thickness of about 30 μm so that the belt 105 can withstand thermal stress and mechanical stress.

The primer layer 105*b* is a layer for bonding the base layer 105*a* and the elastic layer 105*c* to each other. The primer layer is formed on the base layer 105*a* by applying a primer in a thickness of about 5 μm.

The elastic layer 105*c* performs a function such that the parting layer 105*d* is closely contacted to the toner image by being deformed when the toner image is press-contacted to the belt 105 in the nip 101*b*. As the elastic layer 105*c*, a heat-resistant rubber can be used.

The parting layer 105*d* is a layer having a function of preventing deposition of the toner and paper dust on the belt 105. As the parting layer 105*d*, it is possible to use a fluorine-containing resin (material) such as PFA resin excellent in parting property and heat-resistant property. A thickness of the parting layer 105*d* in this embodiment is 20 μm in consideration of a heat-conductive property.

(2-4) Constitution of Pressing Roller and Pressing Method

The pressing roller 102 is a nip forming member for forming the nip 101*b* between itself and the belt 105 in contact with an outer peripheral surface of the belt 105. The pressing roller 102 in this embodiment is a roller member constituted by a plurality of layers. Specifically, the pressing roller 102 includes a core metal 102*a* of metal (aluminum or iron), an elastic layer 102*b* formed of a silicone rubber or the like, and a parting layer 102*c* covering the elastic layer 102*b*. The parting layer 102*c* is a tube using a fluorine-containing resin (material) such as PFA as a material thereof and is bonded onto the elastic layer.

Figure 7:
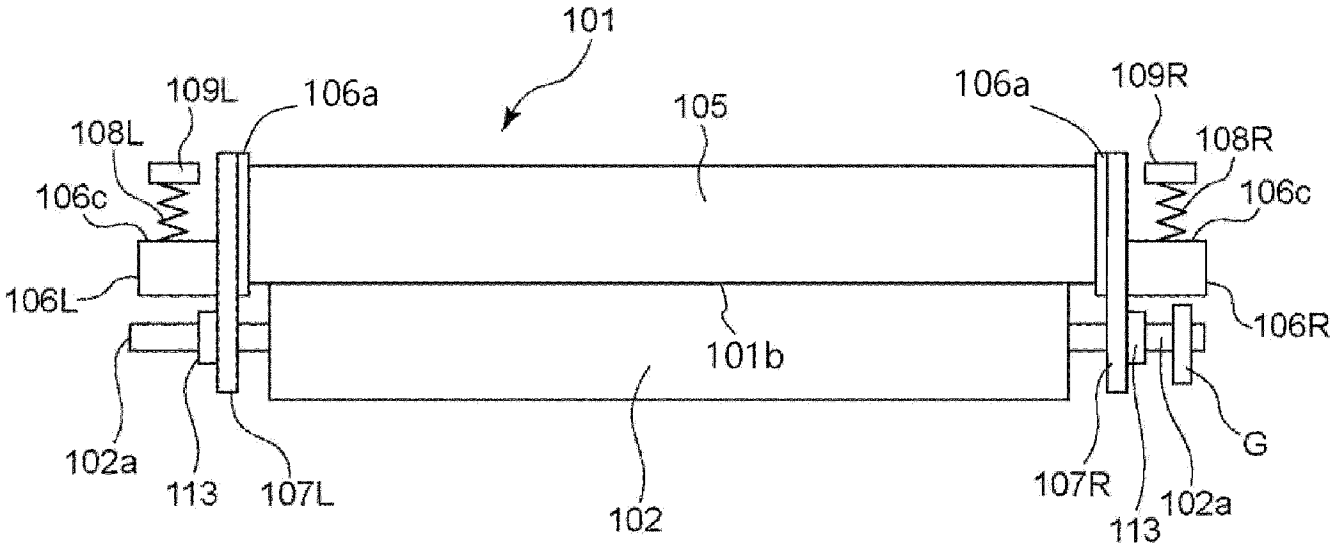
FIG. 7 is a view showing a pressing mechanism of a fixing belt unit.

As shown in FIG. 7, one end side of the core metal 102*a* is rotatably supported by a side plate 107L via a bearing 113 on one end side of the casing 100. The other end side of the core metal 102*a* is rotatably supported by a side plate 107R via a bearing 113 on the other end side of the casing 100. At this time, of the pressing roller 102, a portion including the elastic layer 102*b* and the parting layer 102*c* is positioned between the side plate 107L and the side plate 107R.

The other end side of the core metal 102*a* is connected to a gear G, and when the gear G receives drive from a driving motor (not shown) controlled by the control circuit portion A, the pressing roller 102 is rotationally driven as a rotatable driving member in an arrow R102 direction at a predetermined peripheral speed.

The fixing unit 101 is supported by the side plate 107L and the side plate 107R so as to be slidable and movable in a direction toward and away from the pressing roller 102. Specifically, the flanges 106L and 106R are provided so as to engage with guiding grooves (not shown) of the side plate 107L and the side plate 107R. Then, by the pressing springs 108L and 108R supported by spring supporting portions 109L and 109R, the portions-to-be-pressed 106*c* of the flanges 106L and 106R are pressed in a direction toward the pressing roller 102 by a predetermined pressing force T.

By the pressing force T, entirety of the flanges 106L and 106R, the pressing stay 104*a* and the heater holder 104 is urged in the direction of the pressing roller 102. Here, the fixing unit 101 faces the pressing roller 102 on a side where the heater 101*a* is provided. For that reason, the heater 101*a* presses the belt 105 toward the pressing roller 102. By such a constitution, the belt 105 and the pressing roller 102 are deformed, so that the nip 101*b* (see part (b) of FIG. 6) is formed between the belt 105 and the pressing roller 102.

Thus, when the pressing roller 102 rotates (R102) in a state in which the fixing unit 101 and the pressing roller 102 are in an intimate contact with each other, by a frictional force between the belt 105 and the pressing roller 102 in the nip 101*b*, a rotation torque acts on the belt 105. The belt 105 is rotated (R105) by the pressing roller 102. At this time, a rotational speed of the belt 105 substantially corresponds to a rotational speed of the pressing roller 102. That is, in this embodiment, the pressing roller 102 has a function as a driving roller for rotationally driving the belt 105.

Incidentally, at this time, an inner peripheral surface of the belt 105 and the heater 101*a* slide with each other, and therefore, it is desirable that grease is applied onto the inner surface of the belt 105 and a sliding resistance is decreased.

(2-5)

By using the above-described constitution, the fixing device 103 performs the fixing process during the image forming process. When the fixing process is performed, the control circuit portion A controls the driving motor (not shown), so that the pressing roller 102 is rotationally driven in the rotational direction R102 (FIG. 1) at a predetermined speed and the belt 105 is rotated (R105) by the pressing roller 102.

Further, the control circuit portion A starts energization to the heater 101*a* through a power source circuit (not shown). The heater 101*a* generating heat by this energization imparts heat to the belt 105 rotating while the inner surface thereof slides with the heater surface in intimate contact with the heater surface in the nip 101*b*. Thus, the belt 105 to which the heat is imparted gradually becomes a high temperature.

Here, the thermistor TH is provided on a top surface of the pressing stay 104*a* and elastically contacts the inner surface of the rotating belt 105. By this, the thermistor TH detects a temperature of the belt 105 and feeds back a detection temperature information thereof to the control circuit portion A. The control circuit portion A controls electric power supplied to the heater 101*a* on the basis of a signal outputted by the thermistor TH so that a surface temperature Tb of the belt 105 is a target temperature Tp (see part (a) of FIG. 14). The target temperature Tp (part (a) of FIG. 14) is about 170° C.

When the belt 105 is heated to the target temperature Tp, the control circuit portion A controls the respective constituent elements, so that the sheet P carrying the toner image S (part (a) of FIG. 5) is fed to the fixing device 103. The sheet P fed to the fixing device 103 is nipped and fed by the nip 101*b*.

In a process in which the sheet P is nipped and fed, heat of the heater 101*a* is imparted to the sheet P through the belt 105. The unfixed toner image S is melted by the heat of the heater 101*a*, and is fixed on the sheet P by pressure exerted on the nip 101*b*. The sheet P passed through the nip 101*b* is guided to the discharging roller pair 14 by the guiding member 15, and is discharged on the discharge tray 16 through the discharging roller pair 14. In this embodiment, the above-described step is called the fixing process.

(3) Dust

Next, generation of ultrafine particles (hereinafter, referred to as dust) resulting from a parting agent (hereinafter, referred to as a wax) contained in the toner, and a property of the dust will be described.

(3-1) Relationship Between Wax Contained in Toner and Dust

As described above, the fixing device 103 fixes the toner image S on the sheet P by causing the high-temperature belt 105 to contact the sheet P. In the case where the fixing process is performed by using such a constitution, a part of the toner is transferred (deposited) on the belt 105 during the fixing process in some instances. This is called an offset phenomenon. The offset phenomenon causes an image defect, and therefore, it is desirable that this is solved.

Therefore, in this embodiment, a wax (parting agent) consisting of paraffin is incorporated in the toner used for formation of the toner image S. This toner is constituted such that the wax therein melted and bleeds out when the toner is heated. For that reason, when the image formed by this toner is subjected to the fixing process, the surface of the belt 105 is covered with the melted wax. On the belt 105 covered with the wax at the surface thereof, by parting action of the wax, the toner is not readily deposited.

In this embodiment, in addition to a pure wax, a compound containing a molecular structure of the wax is also called the wax. For example, a compound obtained by reaction of a resin molecule of the toner with a wax molecular structure of a hydrocarbon chain or the like is also referred to as the wax. Further, as the parting agent, in addition to the wax, a substance having parting action, such as silicone oil may also be used.

A part of the wax deposited on the belt 105 vaporizes when a surface temperature of the belt 105 is a certain temperature or more. Further, when a vaporized (gassified) wax is cooled in the air, particles with a predetermined particle size, specifically, dust (fine particles) of about several nm to about several hundred nm generates. Incidentally, most of the dust generated is predicted to have a particle size of several nm to several tens of nm.

This dust generation (formation) phenomenon is called nucleation and is caused by subjecting a vaporized wax component vaporized by heating to a lower temperature environment. This is referred to as overcooling. This phenomenon is the same as a phenomenon that when a temperature of water vapor is below a dew-point temperature, the water vapor becomes a small water droplet and generates fog. A degree of the overcooling can be represented by an overcooling degree ΔT which is a difference between a dust generation temperature Tws (see part (b) of FIG. 9) which is a temperature at which the dust starts to generate when a volatile matter is gradually heated and a spatial temperature Ta of a space in which nucleation occurs at a peripheral portion.

$$\text{Overcooling degree } \Delta T = Tws - Ta \qquad \text{formula (1)}$$

As ΔT is larger, the vaporized wax component is quickly cooled, so that the nucleation is liable to occur. This means that the nucleation occurs at more places. That is, it means that as ΔT is larger, particles are capable of being formed in a larger amount. Further, as ΔT becomes small, the number of places where the nucleation occurs decreases. Further, at that time, gas agglomerates on the formed nuclei, and therefore, particles become large.

Large ΔT-->Small dust generates in a large amount.

Small ΔT-->Large dust generates in a small amount.

Figure 8:
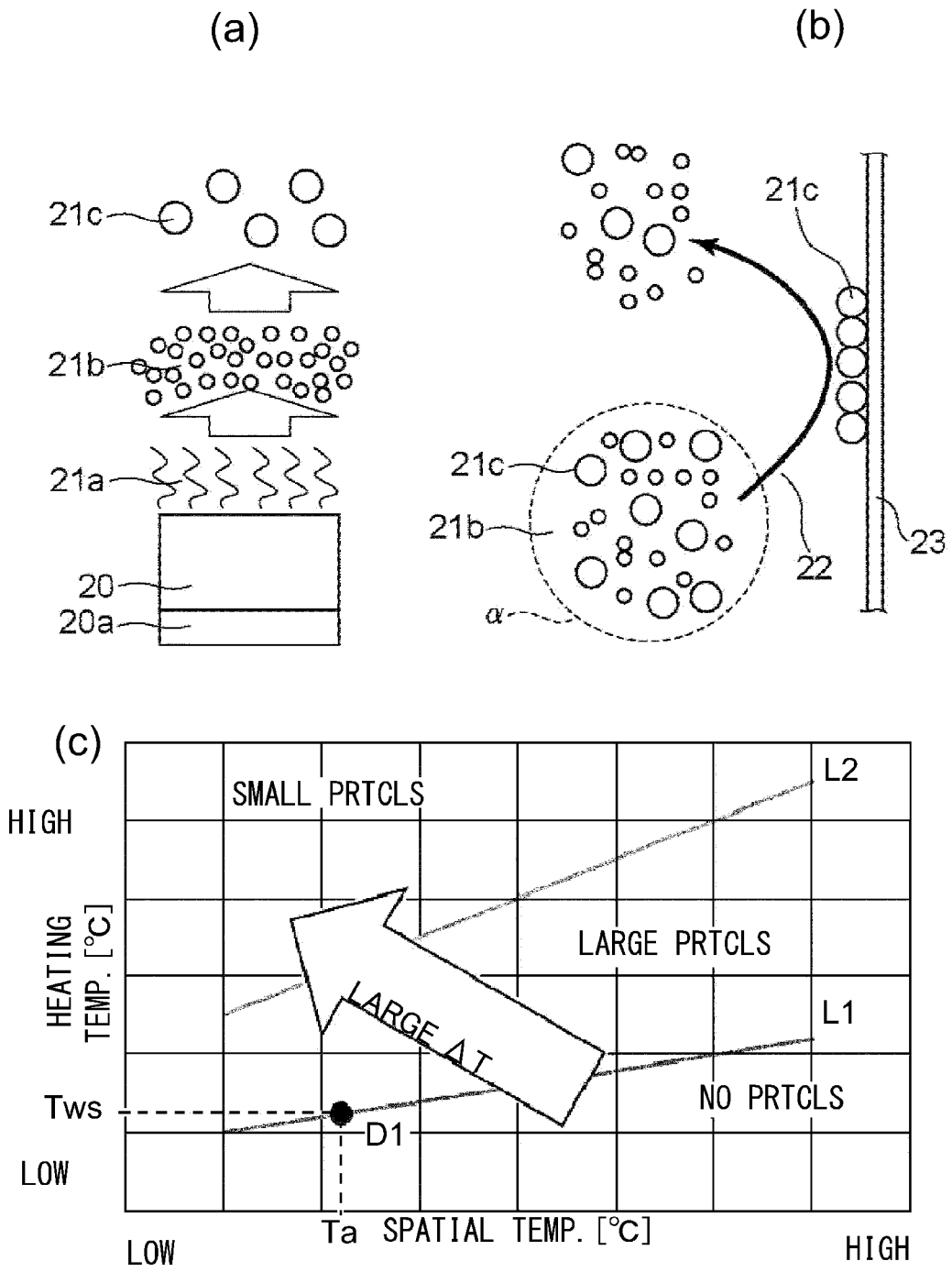
In FIG. 8, part (a) is a view illustrating a dust generating process, part (b) is a view illustrating a dust deposition phenomenon, and part (c) is a graph illustrating that presence or absence of dust generation and a size of particles are determined by a relationship between a heating temperature of toner and an ambient spatial temperature.

The dust comprises a wax component having adhesiveness, and therefore, is liable to deposit on each of places of inside constituent elements of the printer 1 (see part (b) of FIG. 8), so that the case where there arises a problem exists. For example, in the case where the dust D is carried to a peripheral portion of the guiding member 15 and the discharging roller pair 14 by upward current due to heat of the fixing device 103, there is a liability that the wax deposits and accumulates on the guiding member 15 and the discharging roller pair 14, and are fixed thereon. When the guiding member 15 and the discharging roller pair 14 are contaminated with the wax, the wax deposits on the sheet P and causes an occurrence of an image defect. For that reason, the printer 1 includes the filter 51 for removing the dust, so that an occurrence of such a problem is prevented.

However, the filter 51 deteriorated also by, in addition to suction of the dust D, suction of paper powder generating from paper and scattered toner resulting from the unfixed toner on the sheet P. For that reason, the first fan 61 for sucking the air into the filter 51 may desirably actuate only when the dust D generates. In this embodiment, generation of the dust D is predicted by the overcooling degree ΔT, and the first fan 61 is properly controlled.

(3-2) Generation of Dust with Fixing Process (3-2-1) Property of Dust

In the following, a property of the dust will be specifically described using parts (a) to (c) of FIG. 8. Part (a) of FIG. 8 is a view illustrating a state in which the dust generates and grows. Part (b) of FIG. 8 is a view illustrating a deposition phenomenon of the dust. Part (c) of FIG. 8 is a graph illustrating a relationship between a heating temperature of the wax, a spatial temperature of a peripheral portion of the heating portion, the overcooling degree ΔT, and a dust size.

As shown in part (a) of FIG. 8, when a high boiling-point substance 20 of 150° C. or more and 200° C. or less in boiling point is placed on a heating source 20*a* and is heated to about 200° C., a volatile matter 21*a* generates from the high boiling-point substance 20. The volatile matter 21*a* is overcooled when it touches the ambient air, and therefore, condenses in the air, so that the volatile matter 21*a* changes to minute dust 21*b*.

Further, the volatile matter 21*a* which was not changed to the dust gathers and agglomerates at a peripheral portion of the minute dust 21*b*, and in addition, coalescence due to collision between particles of the minute dust 21*b* occurs, and therefore, the minute dust 21*b* grows to large dust 21*c*. At this time, agglomeration/dust formation of the gas in the air is hindered as shown in part (c) of FIG. 8 as the heating temperature is low and the spatial temperature is high, i.e., as the temperature data goes toward a lower right direction (a direction in which the overcooling degree becomes small) in the figure. This is because a volatilisation amount of the gas which is a seed of the dust generation (formation) becomes small as the heating temperature is low (condition-->small) and saturated vapor pressure of the gas increases as the spatial temperature is high (overcooling degree-->small) and thus a gas molecule easily maintains a gas state.

That is, the dust formation is hindered with a smaller overcooling degree ΔT. Lines L1 and L2 in part (c) of FIG. 8 schematically show regions where the dust generation (formation) phenomenon changes. When the heating temperature and the spatial temperature enter a region which is rightward below the line L1 shown in part (c) of FIG. 8, the dust does not generate (form). On the other hand, the dust generation in the air is promoted as the heating temperature is high and the spatial temperature is low, i.e., as the temperature data goes toward an upper left direction (overcooling degree-->large) than the line L1 shown in part (c) of FIG. 8. This is because the volatilization amount of the gas which is the seed of the dust generation becomes large as the heating temperature is high and the vapor pressure of the gas lowers as the spatial temperature is low and thus formation of particles of the gas molecules is promoted.

That is, the dust generation is promoted as the overcooling degree ΔT is large, so that many particles of the dust are formed (generated). Further, when the overcooling degree ΔT becomes large and enters a region which is leftward above the line L2, the dust size becomes smaller and at the same time, the number of formation of the particles also becomes larger. This is because when the overcooling degree ΔT becomes large, the number of places where the nucleation occurs also increases.

Incidentally, although the line L2 is shown as a line defining a large particle size dust generation region and a small particle size dust generation region, there is no clear criterion for defining large particle size dust and small particle size dust in actuality. The dust particle size gradually changes by a change in overcooling degree ΔT.

Next, in part (b) of FIG. 8, the case where (A) a containing the minute dust 21*b* and large dust 21*c* moves toward a wall 23 along air flow (air current) 22 will be considered. At this time, the dust 21*c* larger is than the minute dust 21*b* and is liable to deposit on the wall 23 and not be readily diffused. This is predicted because the large dust 21*c* has a large inertial force and vigorously collides against the wall 23. Accordingly, the more formation of dust with a large particle size is promoted while keeping atmosphere at high temperature, the more the dust is liable to deposit inside the fixing device (most thereof deposits on the fixing belt), with the result that the dust is not readily diffused to the outside of the fixing device.

Thus, the dust possesses two properties that coalescence is promoted under high temperature and is formed in particles with the large particle size and that the dust is liable to deposit on a peripheral object by the formation of the dust with the large particle size. Incidentally, ease of the coalescence of the dust depends on a component, a temperature and a density (concentration) of the dust. For example, a component liable to adhere becomes high temperature and soft, and when a collision probability between dust particles increases under a high density, the dust particles are liable to coalescence.

(3-2-2) Dust Generation Temperature Tws

Figure 9:
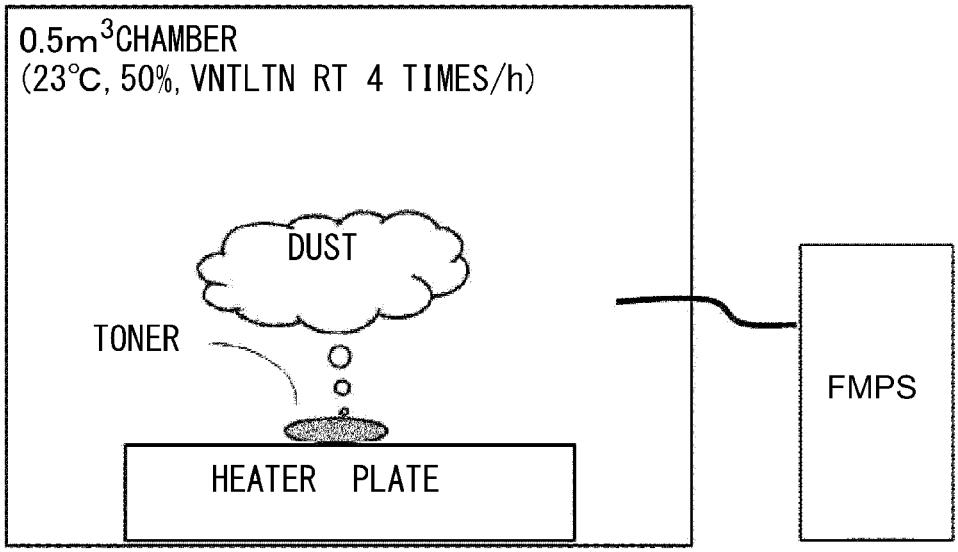
In FIG. 9, part (a) is a view illustrating a measuring device of a dust generation temperature Tws, and part (b) is a graph showing a relationship between a heater temperature and a dust density (concentration).
Figure 9:
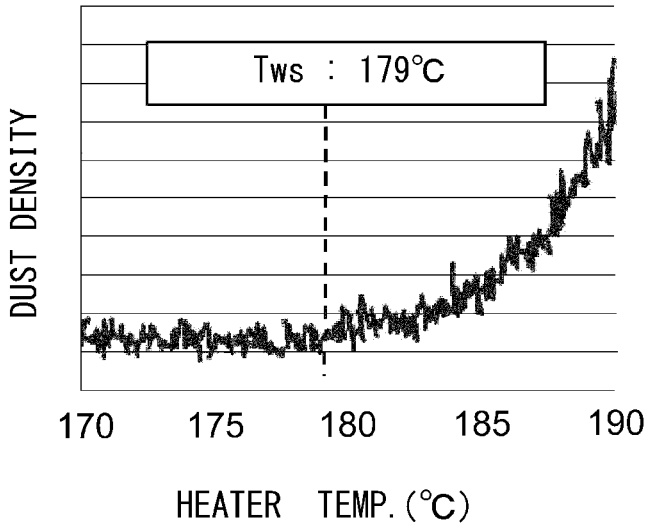

By using a device shown in part (a) of FIG. 9, a method of measuring a dust generation temperature Tws will be described below. Further, in part (b) of FIG. 9, an example of the dust generation temperature Tws is shown. As described above, in this embodiment, generation of the dust is predicted by the overcooling degree ΔT, and the first fan 61 for sucking the air into the filter 51 for removing the dust is controlled. More specifically, control in which the first fan 61 is made non-actuation or efficiency (Duty) of the first fan 61 is lowered is effected. That is, the first fan 61 is actuated at a predetermined second efficiency lowered in efficiency than a predetermined first efficiency.

In the following, the control in which the first fan 61 is made non-actuation may also be control in which the efficiency of the first fan 61 is lowered (control in which the efficiency is switched from the first efficiency to the second efficiency). Control of the fourth fan 64 is also similar to the control of this first fan 61.

The dust generation temperature Tws is used for calculation of the overcooling degree ΔT, and is a physical value intrinsic to the toner, so that here details of a measuring method will be described.

The dust generation temperature Tws is measured using a chamber of an inside volume of 0.5 $m^3$. The chamber is set at a temperature of 23±2° C., a humidity of 50±5% and a ventilation rate of 4 times/h. Further, a heater plate provided inside the chamber is increased in temperature from normal temperature at a temperature increasing rate of 3° C./min. On the heater plate, the toner containing the wax is provided. The dust generating from the wax contained in the toner is measured by FMPS Model 3091 (manufactured by TSI) which is a nanoparticle-particle size distribution measuring device connected to the 0.5 $m^3$-chamber.

Next, an analyzing method of the dust generation temperature Tws will be described. From a result obtained as shown in part (b) of FIG. 9, an average and standard deviation of the dust density in a region (from normal temperature to about 170° C. in this experiment) where the dust does not generate are calculated. Then, a dust density variation of a measuring system is calculated as an "average+3×standard deviation". At this time, a temperature when the dust density exceeding the "average+3×standard deviation" which is the measuring system variation is defined as the dust generation temperature Tws.

In this experiment, 179° C. was the dust generation temperature Tws. Incidentally, the temperature at which the dust generates depends on the spatial temperature in the chamber as apparent from part (c) of FIG. 8. As the spatial temperature is low, the heating temperature when the dust generates also becomes low. The dust generation temperature Tws measured under the above-described condition is represented by D1 which is a point on the line L1 when applied to part (c) of FIG. 8.

(3-2-3) Difference Between Generation Temperature of Dust in Printer and Tws

In the printer 1, the dust generates from the wax deposited on the belt 105. A surface temperature of the belt 105 when the dust starts to generate is the generation temperature of the dust in the printer 1. However, this temperature is about 20° C. lower than Tws obtained by the above-described dust generation temperature measuring method. This results from that a space where the dust generates in the printer 1, i.e., a temperature of the space in the neighborhood of the belt 105 is liable to become lower than a temperature of a dust generation space above the heater plate.

The space in the neighborhood of the heated belt 105 is liable to become low temperature because cold air is sucked from the outside air by the air flow generated with the rotation of the belt 105, and therefore, is liable to become the low temperature. On the other hand, in the device of part (a) of FIG. 9, a dust generation space above the heater plate is cooled by the air flow (weaker than an air flow generated by rotation of the belt 105) generated by heat convection, and therefore, a lowering range of the temperature is more moderate than a peripheral portion of the belt 105. As a result, a spatial temperature of the peripheral portion of the belt 105 becomes lower than the temperature of the dust generation space above the heater plate even when the printer 1 is placed in an environment of 23° C. which is the same temperature as in the chamber.

When description is made using part (c) of FIG. 8, the dust generation temperature in the printer 1 becomes a point shifted in a direction in which the spatial temperature is lower than the spatial temperature at the point D1 on the line L1, i.e., in a lower left direction on the line L1. As a result, the temperature at which the dust generates also lowers. This temperature lowering range is, according to the present inventors, about 20° C. in the printer 1 of the embodiment.

Generation temperature of dust in printer 1=dust generation temperature *Tws−Z*

When the above-described temperature lowering range is a preset adjusting temperature value Z (° C.), the dust generation temperature Tws in the printer 1 is represented by the following formula as a general formula.

Figure 10:
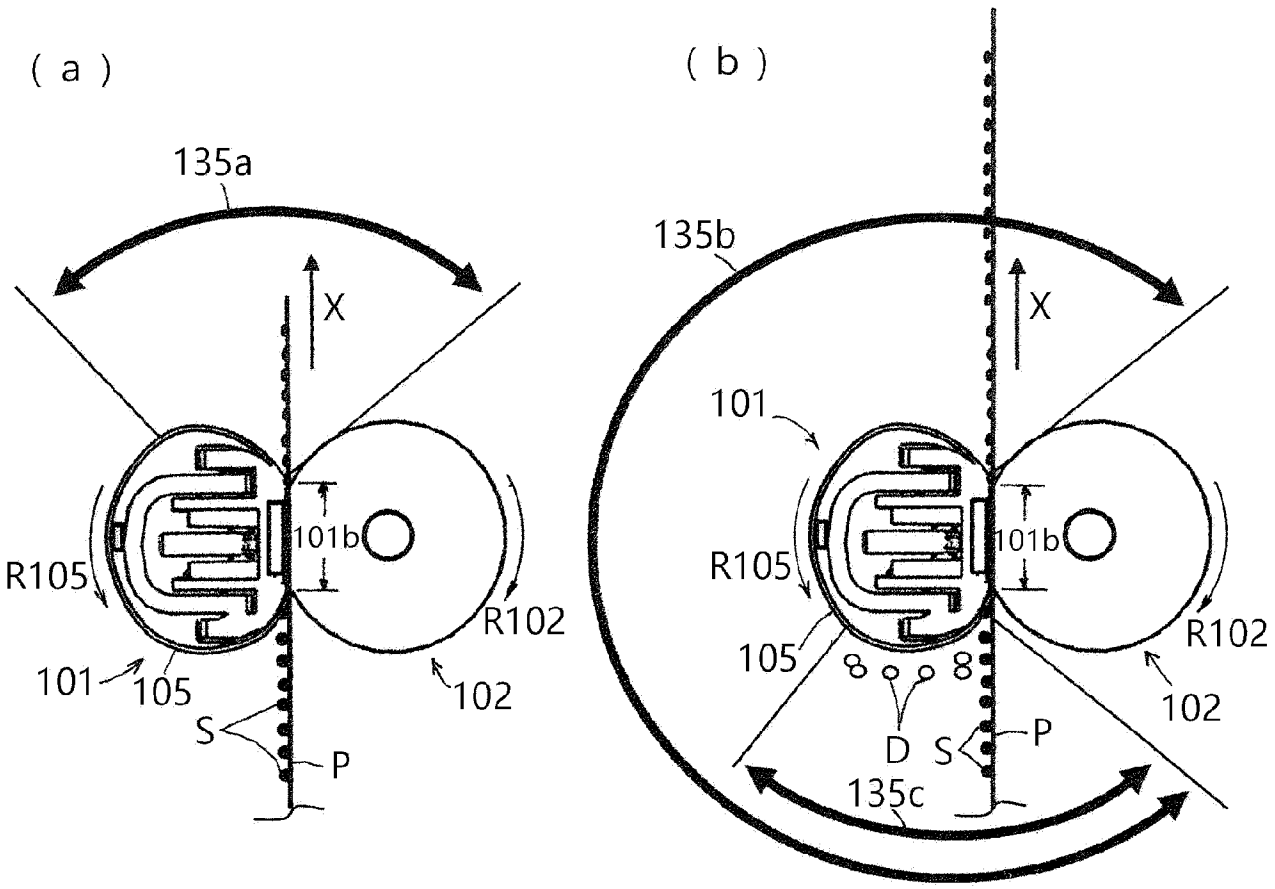
In FIG. 10, part (a) is a view showing a state of a wax deposition region, on the fixing belt, enlarged with progress of a fixing process, and part (b) is a view showing a relationship between the wax deposition region and a generation region of dust D.
Figure 11:
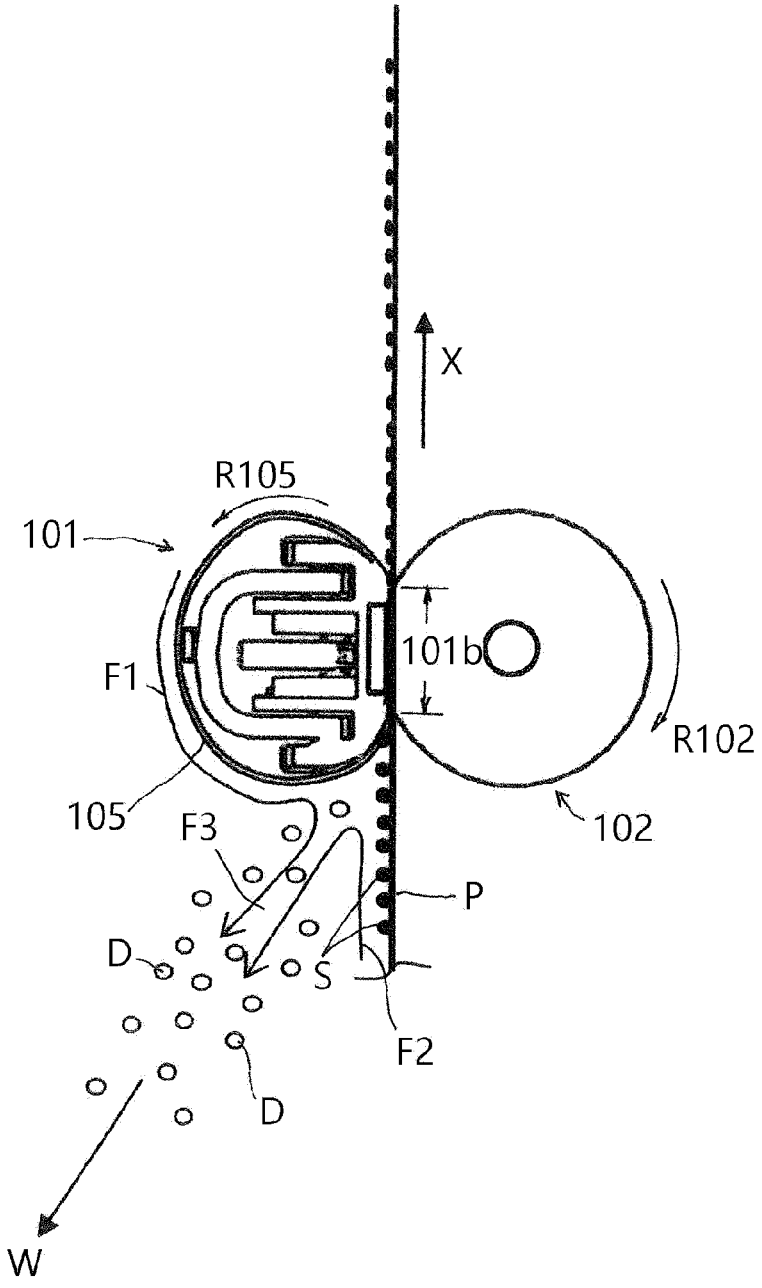
FIG. 11 is a view illustrating a flow of air flow (current) at a peripheral portion of a fixing belt.

Generation temperature of dust in printer 1=dust generation temperature $Tws-Z$ (3-2-4) Generation Place of Dust D Next, a generation place of the dust D will be described on the basis of FIG. 10 and FIG. 11. Part (a) of FIG. 10 is a view showing a wax deposition region on the belt 105 enlarged with progress of the fixing process. Part (b) of FIG. 10 is a view showing a relationship between the wax deposition region and a generation region of the dust D. FIG. 11 is a view illustrating a flow of the air flow of the peripheral portion of the belt 105.

When the present inventors conducted verification, it turned out that as regards the dust D generating from the fixing device 103, a generation amount is larger on an upstream side of the nip 101*b* than on a downstream side of the nip 101*b*. In the following, a mechanism thereof will be described.

Heat is taken by the sheet P on the surface (parting layer 105*d*) of the belt 105 immediately after the belt 105 passes through the nip 101*b*, and therefore, a temperature thereof lowers to about 100° C. On the other hand, the temperature of an inner surface/back surface (base layer 105*a*) of the belt 105 is kept at high temperature by contact with the heater 101*a*. For that reason, after the belt 105 passes through the nip 101*b*, the heat of the base layer 105*a* kept at the high temperature is conducted to the parting layer 105*d* through the primer layer 105*b* and the elastic layer 105*c*.

Therefore, the temperature of the surface (parting layer 105*d*) of the belt 105 increases after the belt 105 passes through the nip 101*b* in a process in which the belt 105 rotates in the arrow R105 direction (FIG. 10) and reaches a highest temperature in the neighborhood of an entrance side of the nip 101*b*.

On the other hand, the wax bleeding out of the toner on the sheet P exists at an interface between the belt 105 and the toner image S when the fixing process is performed. Thereafter, a part of the wax deposits on the belt 105. As shown in part (a) of FIG. 10, in a stage in which a part of the sheet P on a leading end side passes through the nip 101*b*, the wax transferred from the toner onto the belt 105 exists in a region 135*a*. In this region 135*a*, the temperature of the belt 105 is low and the wax is not readily volatilized, and therefore, the dust D little generates.

When the sheet P advances in the nip 101*b*, the wax is in a state in which the wax exists over a substantially full circumference (135*b*) of the belt 105. Of this, in a region 135*c*, the belt becomes high temperature, and therefore, the wax is liable to volatilize. Then, when the wax volatilized from the region 135*c* condenses, the dust D generates. For that reason, many particles of the dust D exist in the neighborhood of the region 135*c*, i.e., in the neighborhood of (on the side upstream) of the entrance of the nip 101*b*.

Further, the dust D in the neighborhood of the entrance of the nip 101*b* diffuses in an arrow W direction by air flows shown in FIG. 11. Description is specifically made as follows. As shown in FIG. 11, when the belt 105 rotates in the arrow R105 direction, an air flow F1 along the R105 direction generates in the neighborhood of the surface of the belt 105. Further, when the sheet P is fed along an X direction, an air flow F2 along the feeding direction X of the sheet P generates.

Figure 1:
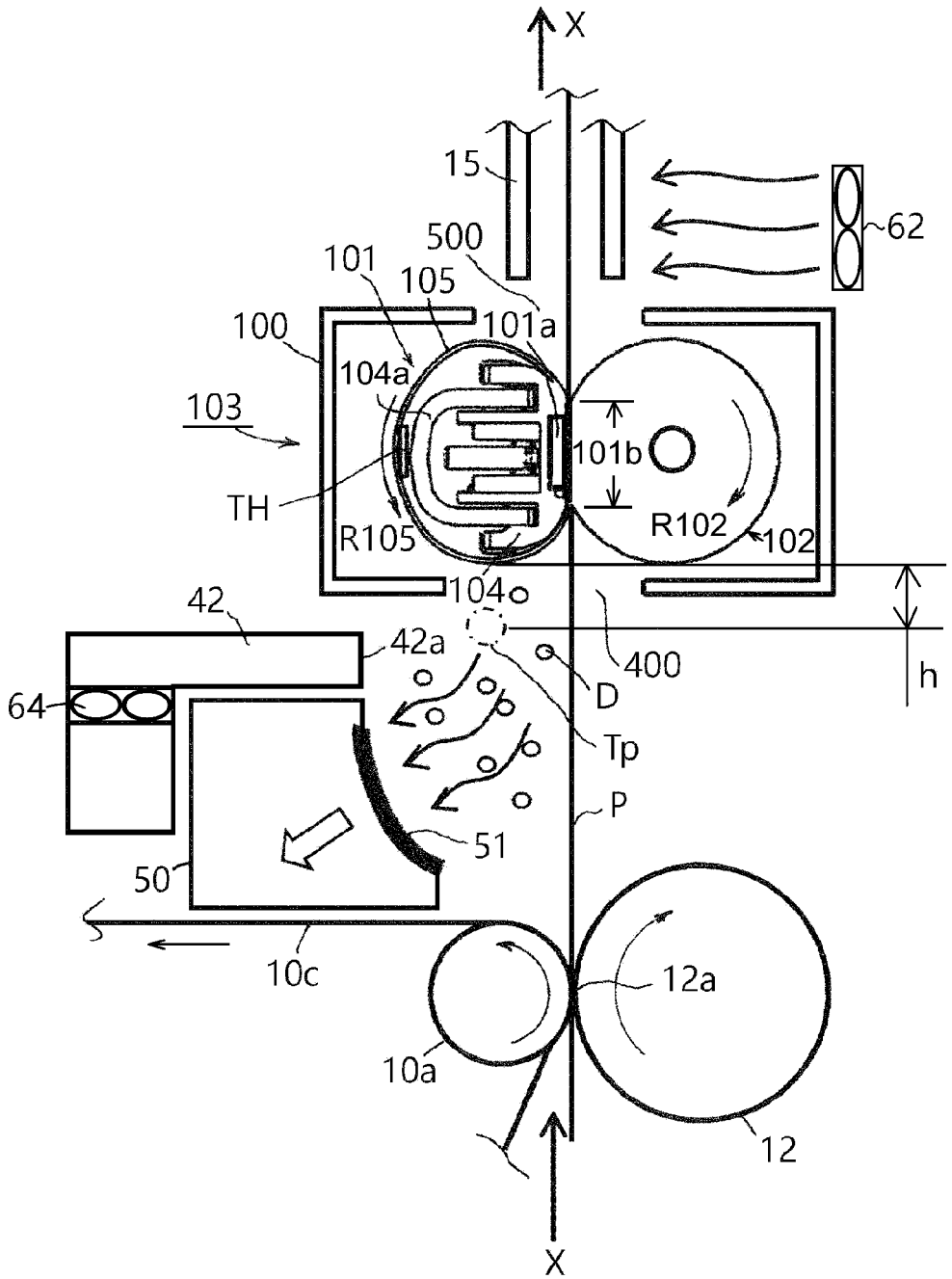
FIG. 1 is a view showing a state in which dust is collected in the neighborhood of a fixing device in an image forming apparatus of an embodiment 1.

When the air flow F1 and the air flow F2 collide with each other in the neighborhood of the nip 101*b*, the air flow F2 generates along a direction (W direction) in which the air flow F3 moves away from the nip 101*b*. Although details will be described later, the filter 51 for removing the dust is disposed in the W direction which is a direction in which the dust D is carried by the air flow F3 (FIG. 1).

(3-2-5) Measuring Point of Spatial Temperature Ta and Manner of Acquiring Ta

A position of a measuring point Tp of the spatial temperature Ta used for calculation of the overcooling degree ΔT (=Tws−Ta) will be described using FIG. 1. The spatial temperature Ta is a temperature of a space in which the nucleation occurs in the peripheral portion of the belt 105.

It is difficult to accurately measure a range of the space in which the nucleation occurs, but as a result that the present inventor measured a dust density of the peripheral portion of the belt 105, it was predicted that the nucleation occurred within a range of 20 mm or less from the belt 105 toward the direction of the transfer portion 12*a*.

Further, in the case where the position of the measuring point Tp is excessively close to the belt 105, the measuring point Tp is strongly influenced by the heat of the belt 105, so that there is a possibility that the spatial temperature Ta cannot properly measured. For that reason, it would be considered that there is a need to space the measuring point Tp from the belt 105 by at least 1 mm.

Therefore, the position of the measuring point Tp may pass through a cross-sectional plane center of the belt 105 and a central portion of the belt 105 with respect to a longitudinal direction of the belt 105, and may fall within a range of 1 mm or more and 20 mm or less from the surface of the belt 105 toward the transfer portion 12*a*. In this embodiment, a distance h from the belt 105 to the measuring point Tp is 6 mm.

Incidentally, as a manner (method) of acquiring the temperature of the measuring point Tp, i.e., the spatial temperature Ta, other than a method of measuring the spatial temperature Ta by a temperature detector, a method of predicting the spatial temperature Ta from temperature information of the printer and operation information of the fan would be considered. In this embodiment, a latter method is used, and a temperature detecting means 67 incorporated in the control circuit portion A shown in FIG. 12 predicts the spatial temperature Ta. In the following, an example of a predicting method of the spatial temperature Ta by the temperature detecting means 67 will be described.

When an inside temperature of the image forming apparatus measured by the above-described inside temperature sensor 65 of the image forming apparatus is Tin, an outside temperature measured by the outside temperature sensor 66 of the image forming apparatus is Tout, a surface temperature of the belt 105 predicted from a temperature of the thermistor TH is Tb, Duty of the first fan 61 during actuation is FAN 1_duty, Duty of the second fan 62 during actuation is FAN 2_duty, Duty of the third fan 63 during actuation is FAN 3_duty, and Duty of the fourth fan 64 during actuation is FAN 4_duty, the temperature detecting means 67 predicts Ta from the following formula.

$$Ta=Tin+A\times Tb-B\times Tout\times FAN\ 1_duty-C\times Tout\times FAN\ 2_duty-D\times Tout\times FAN\ 3_duty-E\times Tout\times FAN\ 4_duty$$

Incidentally, Tb is a value obtained by subtracting 10° C. from a detection temperature of the thermistor TH. A constituent material of the belt 105 has a resistance of heat conduction, and therefore, the surface temperature of the belt 105 is about 10° C. lower than a back-surface temperature of the belt detected by the thermistor TH. Further, in the formula, A, B, C, D and E are constants.

A first term of a right(-hand) side in the above-described formula means that Ta is determined on the basis of the inside temperature Tin of the image forming apparatus. A second term means that Ta which is the spatial temperature of the measuring point Tp is increased by the heat of the surface temperature Tb of the belt 105. For that reason, a sign of the second term is plus.

A third term to sixth term mean that Ta is influenced by actuation of the fans having a function of sucking the outside air (temperature Tout) to the measuring point Tp. That is lower than Tin and Ta, and therefore, Ta shifts in a lowering direction by the actuation of the fans. For that reason, signs of the third, fourth, fifth and sixth terms are minus. The constants A, B, C, D and E are determined so that a temperature obtained by actually measuring the temperature at the measuring point Tp through an experiment and a predicted value Ta by the above-described formula coincide with each other.

Incidentally, as parameters used for predicting Ta, in addition to the above parameters, a size, a feeding speed and the number of fed sheets for the sheet P, and Duty of the fans during actuation, and further an operation frequency of each of the fans may also be included.

Figure 16:
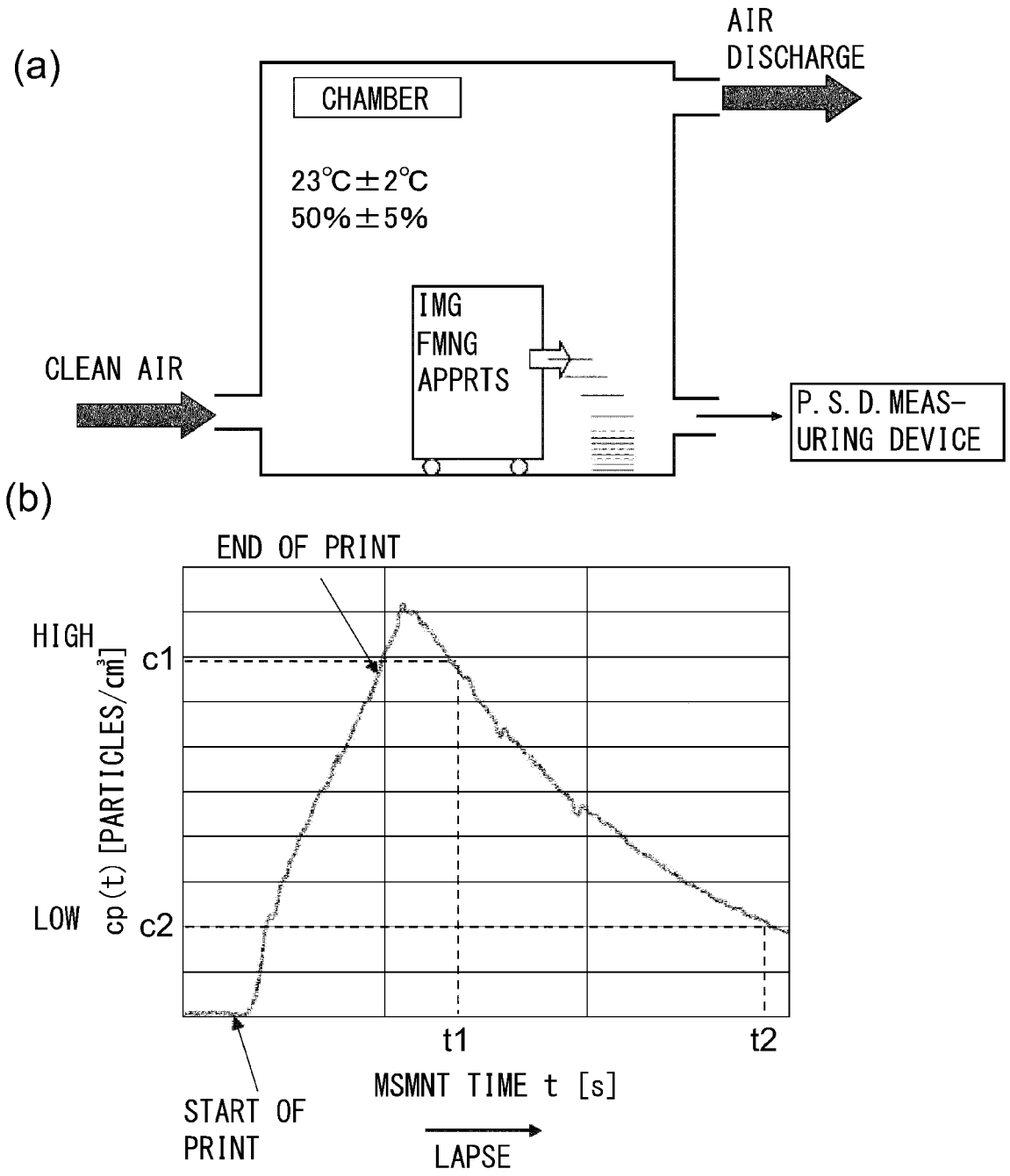
In FIG. 16, part (a) is a view illustrating a measuring system of a dust generation amount, and part (b) is a graph illustrating a measurement result of the dust generation amount.

(3-3) Measurement of Dust Generation Amount (3-3-1) Measuring Device of Dust Generation Amount In part (a) of FIG. 16, a measuring device of a generation amount of the dust generating from the printer (image forming apparatus) is shown. The generation amount of the dust was, as shown in part (a) of FIG. 16, a test device (chamber volume: 6 $m^3$, ventilation rate: 2 $m^3$/h) in accordance with German Environmental Label "Blue Angel Mark". Incidentally, the dust generation amount is measured in accordance with RAL-UZ205 by using FMPS Model 3091 (manufactured by TSI), which is nanoparticle-particle size measuring device. When an outline there is described, the printer was installed in the chamber and a background was measured for 5 minutes, and thereafter, printing was carried out for 10 minutes, and a dust density in the chamber is measured for 70 minutes.

(3-3-2) Analyzing Method of Dust Generation Amount

Also as regards an analyzing method, similarly, analyzation is performed in accordance with RAL-UZ 205. In part (b) of FIG. 16, an example of a result acquired in the above-described measuring system is shown. First, particle disappearance coefficient β [1/s] by ventilation or the like of the chamber is calculated. As regards the particle disappearance coefficient β, a point of a region where the number of particles decreases after an end of printing is t1, and t1+25 minutes is t2. When dust densities at this time are c1 and c2, respectively, the particle disappearance coefficient β is:

$$\beta = \frac{\ln\left(\frac{C1}{C2}\right)}{t2 - t1}. \tag{1}$$

Further, from a dust density Cp (t), a measuring time t, a time difference Δt between consecutive two data points, the particle disappearance coefficient β, and a chamber volume Vk, the following instantaneous emulation rate (hereinafter referred to as an instantaneous ER) PER(t) [1/s] is calculated.

$$PER(t) = Vk\left(\frac{Cp(t) - Cp(t - \Delta t)\exp(-\beta \cdot \Delta t)}{\Delta t \cdot \exp(-\beta \cdot \Delta t)}\right) \tag{2}$$

The instantaneous ER PER (t) contains disappearance of particles in calculation thereof, and therefore, shows an amount of the dust emitted per unit time at the time t by the printer. When the above-described formula is subjected to time integration over a full printer time (range), a total amount of the dust emitted during the printing can be acquired.

(3-3-3) Relationship Between Instantaneous ER and Overcooling Degree ΔT

Figure 15:
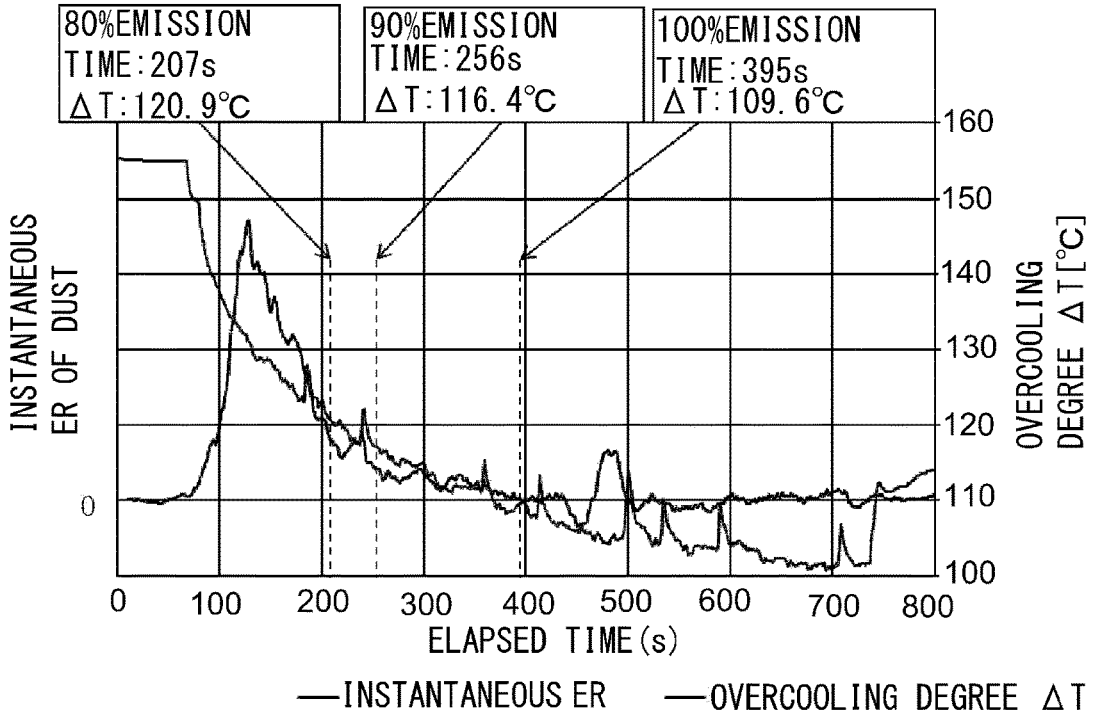
In FIG. 15, part (a) is a graph illustrating an instantaneous ER of dust and progression of an overcooling degree ΔT, and part (b) is a graph illustrating a relationship between a time of an end of discharge of the dust and the overcooling degree ΔT.
Figure 15:
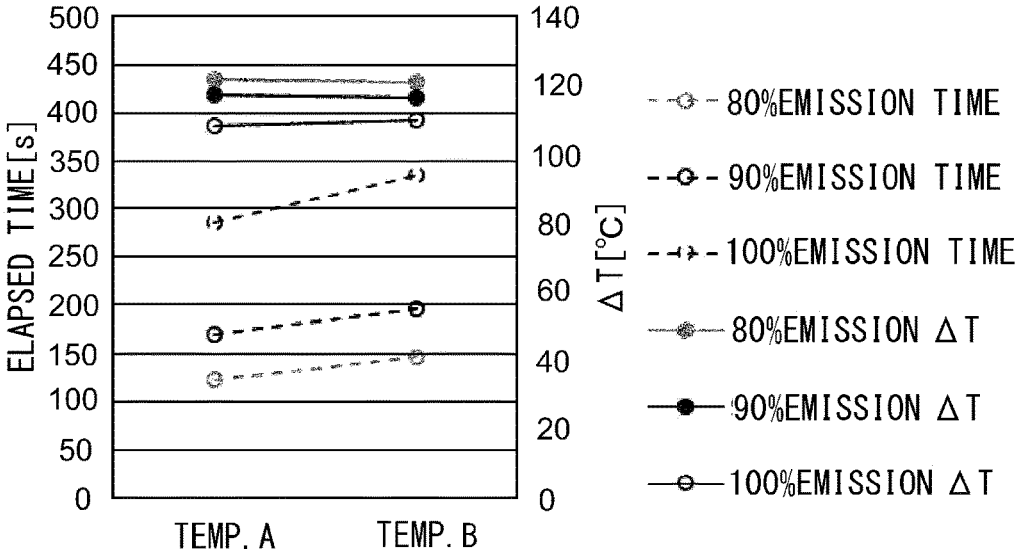

In part (a) of FIG. 15, an example of progression of the instantaneous ER and the overcooling degree ΔT at the time when the printer 1 in this embodiment is operated for about 11 minutes is shown. Incidentally, the surface temperature of the belt 105 at this time is a temperature B. Further, as regards an elapsed time in this graph, 60 sec before a start of the printing is taken as 0 sec.

Part (b) of FIG. 15 is a graph showing a relationship, acquired when the surface temperature Tb of the belt 105 is changed from a temperature A to the temperature B, between an elapsed time after the start of printing (time obtained by subtracting 60 sec from the elapsed time of part (a) of FIG. 15) and the overcooling degree ΔT.

As shown in part (a) of FIG. 15, the instantaneous ER increases from after the start (after 60 sec) of the printing and gradually decreases with a top point of about 120 sec, and finally becomes substantially 0. The reason why the dust decreases although during the printing is due to a decrease in overcooling degree ΔT. Incidentally, as described above, the dust generation amount is acquired by subjecting the instantaneous ER in part (a) of FIG. 15 to the time integration. At this time, the instantaneous ER is integrated from the start of the printing, and the elapsed time and the overcooling degree ΔT when the dust generation amount reaches 80%, 90% and 100% relative to an integrated amount of an entire dust generation amount are acquired. The following is a result thereof.

At time of 80%-emission of dust D:
elapsed time: 207 sec (147 sec after start of printing), overcooling degree ΔT: 120.9° C.,
At time of 90%-emission of dust D:
elapsed time: 256 sec (196 sec after start of printing), overcooling degree ΔT: 116.4° C., and
At time of 100%-emission of dust D:
elapsed time: 395 sec (335 sec after start of printing), overcooling degree ΔT: 109.6° C.

The above is the case where the surface temperature of the belt 105 is B, and also as regards the case of the temperature A, the elapsed time and the overcooling degree ΔT when the dust generation amount reaches 80%, 90% and 100% relative to the integrated amount of the entire dust generation amount by a similar method.

In part (b) of FIG. 15, a result when the measurement was made by changing the surface temperature Tb to the temperatures A and B. Incidentally, the temperature A is a temperature lower than the temperature A. In the case where the elapsed time after the start of the printing and the overcooling degree ΔT at the time when the dust is emitted by 80%, 90% and 100%, respectively, are compared, when the surface temperature Tb of the belt 105 is changed from the temperature A to the temperature B, a time required for emitting the dust increases, but the overcooling degree ΔT is substantially constant. That is, by measuring the overcooling degree ΔT, the time of an end of dust generation can be properly predicted. Here, the overcooling degree when the dust is emitted by 80% or more and 100% or less is a first temperature ΔT_stop.

First temperature ΔT_stop during 80%-emission of dust=120.9° C.

First temperature ΔT_stop during 90%-emission of dust=116.4° C.

First temperature ΔT_stop during 100%-emission of dust=109.6° C.

This value becomes substantially constant unless physical properties such as a boiling point of the wax of the toner and ease of agglomeration of a wax volatile matter are changed.

Further, in order to achieve the function of the printer, the physical properties of the wax have to fall within certain ranges. As a result, the above values are not largely changed even in the case where a constitution of the printer and the toner are changed. That is, when the overcooling degree ΔT is acquired in accordance with the measuring method and the measuring condition which are described above, it is possible to predict the time of the end of the dust emission on the basis of the value of the above-described ΔT_stop for a printer using toner different from the toner in this embodiment and for a printer with a different structure.

(4) Collecting Method of Dust D

Based on the property of the dust described above, a collecting method of the dust D (see FIGS. 1 and 3) generating in the neighborhood of the belt 105 and a suppressing method of generation of the dust D will be described. First, structures and operations of the filter unit 50 for filtering the dust D and the cooling duct 42 for cooling the transfer portion 12*a* will be described, and then an operation sequence of the air flow will be described.

FIG. 1 is a view illustrating a locating position of the filter unit 50. Part (a) of FIG. 2 is a perspective view of an arrangement of constituent elements of a peripheral portion of the fixing device 103. Part (b) of FIG. 2 is a view illustrating a passing position of the sheet P in the peripheral portion of the fixing device 103. Part (a) of FIG. 3 is an exploded perspective view of the filter unit 50. Part (b) of FIG. 3 is a view showing a state in which the filter unit 50 operates.

Figure 13:
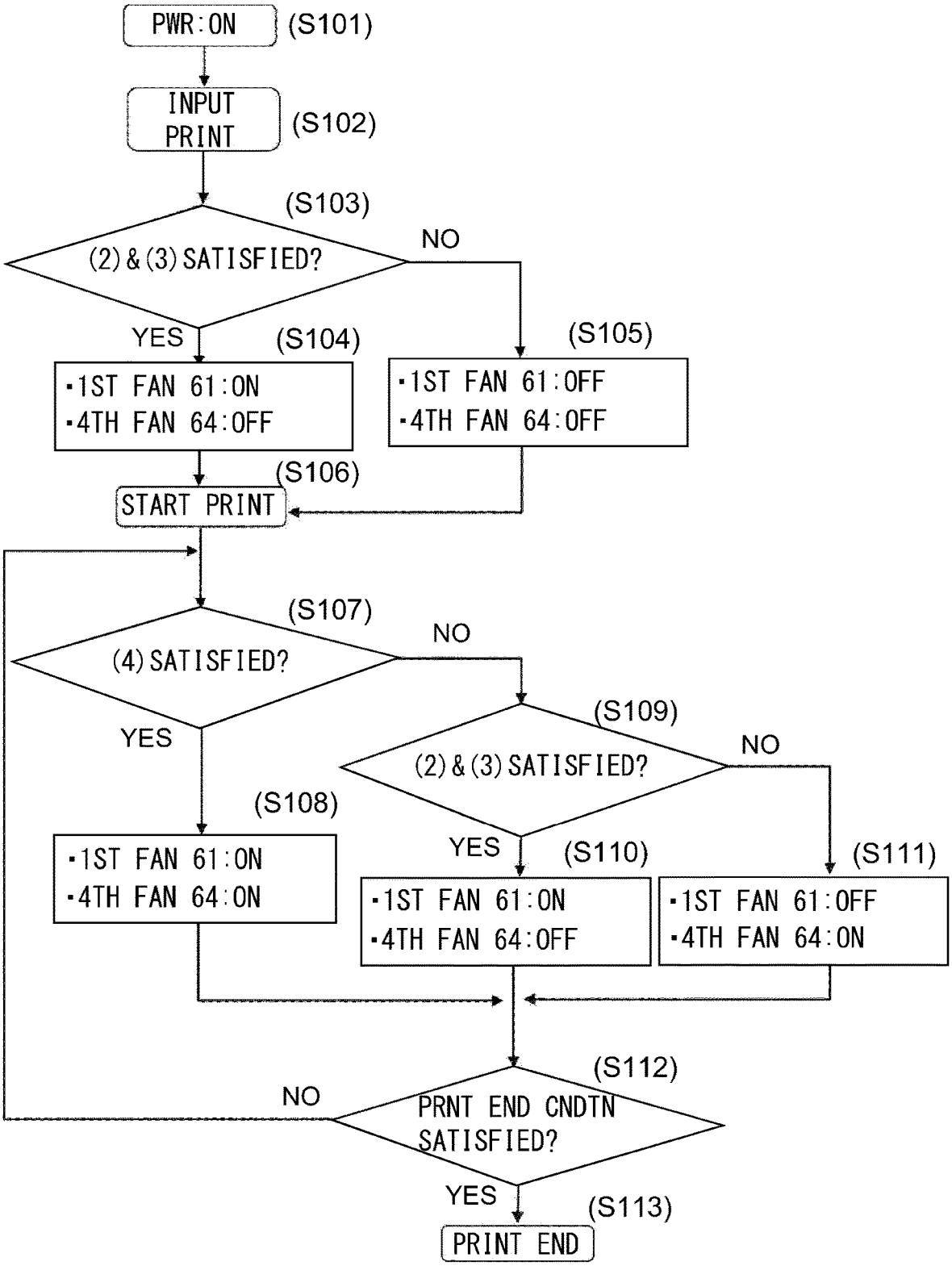
FIG. 13 is a flowchart illustrating control of a fan.
Figure 14:
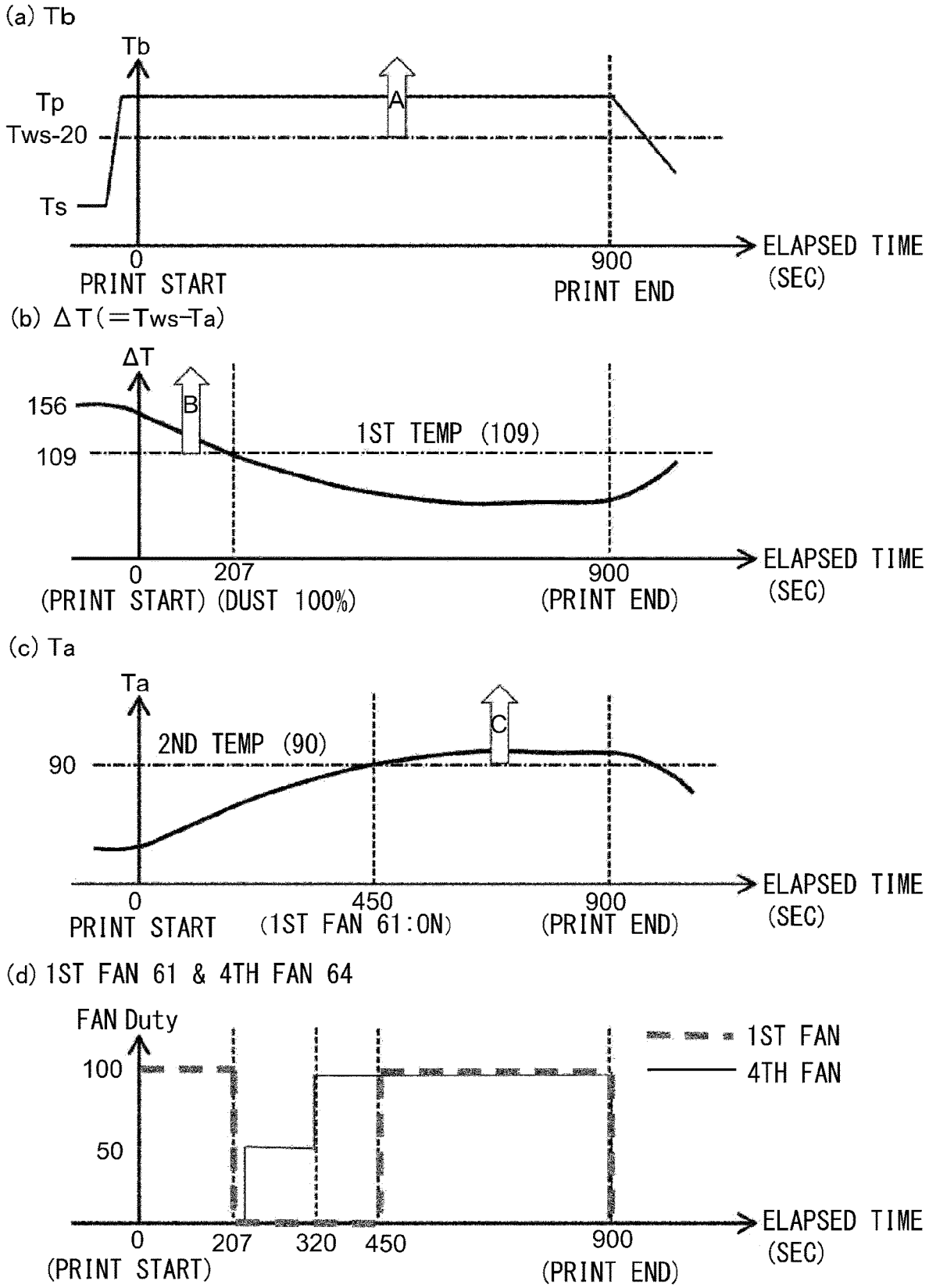
In FIG. 14, parts (a) to (d) are sequence views illustrating a relationship between temperature information and a fan operation.

FIG. 12 is a block diagram showing a relationship between the control circuit portion and each of the constituent elements. FIG. 13 is a flow chart illustrating control of each of the fans. Part (a) of FIG. 14 is a sequence view of the thermistor TH in this embodiment. Part (b) of FIG. 14 is a view showing progression of the overcooling degree ΔT in this embodiment. Part (c) of FIG. 14 is a view showing progression of the spatial temperature Ta in this embodiment. Part (d) of FIG. 14 is a sequence view of the first fan 61 and the fourth fan 64 in this embodiment. Part (a) of FIG. 15 is a graph illustrating a relationship between the instantaneous ER of the dust and the overcooling degree ΔT. Part (b) of FIG. 15 is a graph illustrating a relationship between emission of the dust, the overcooling degree ΔT, and the elapsed time after the start of the printing.

(4-1) Structure of Filter Unit

The filter unit 50 is positioned, as shown in FIG. 1, between the fixing unit 101 and the transfer unit 10 with respect to the feeding direction of the sheet P. Or, the filter unit 50 is positioned between the nip 101*b* of the fixing device 103 and the transfer portion 12*a* of the transfer means.

The filter unit 50 collects the dust D by sucking the air containing the dust D as shown in FIG. 1. The filter unit 50 includes the filter 51 for collecting the dust D, the first fan 61 for sucking the air and the particles, collecting duct 52 for guiding the air so that the air in the neighborhood of the sheet inlet 400 of the fixing device 103 passes through the filter 51.

The first fan 61 is an air sucking portion for sucking the air in the neighborhood of the sheet inlet 400 to the outside of the printer 1. The first fan 61 includes a fan air suction port 61*a* and an air discharge port 61*b*, and generates an air flow from the fan air suction port 61*a* toward the air discharge port 61*b*.

The fan air suction port 61*a* is an opening which is connected to an air discharge port 52*e* of the duct 52 and which is for sucking the air in the duct 52. The air discharge port 61*b* is an opening which is provided toward the outside of the printer 1 and which is for discharging the air, sucked through the fan air suction port 61*a*, toward the outside of the printer 1. The duct 52 is a guiding portion for guiding the air in the neighborhood of the sheet inlet 400 toward the outside of the printer 1. The duct 52 includes an air suction port 52*a* in the neighborhood of the sheet inlet 400 and the air discharge port 52*e* apart from the neighborhood of the sheet inlet 400.

The cooling duct 42 includes the fourth fan 64 (FIG. 1 and part (a) of FIG. 2) which is a cooling air sucking portion, a cooling air suction port 42*a*, and an air discharge port 42*b*. The cooling air suction port 42*a* is disposed between the filter unit 50 and the fixing device 103 as shown in FIG. 1. The cooling duct 42 has a function of preventing a temperature rise of the transfer portion 12*a* by discharging hot air existing between the fixing device 103 and the transfer portion 12*a*.

The printer 1 of this embodiment uses a blower fan as the first fan 61 and uses an axial fan as the fourth fan 64. The blower fan is characterized by high static pressure and is capable of ensuring a certain volume of air (air suction amount) even when an air communication resistor such as the filter 51 exists. On the other hand, the cooling duct 42 is not provided with the air communication resistor such as the filter 51, and therefore, the axial fan characterized by a high air flow rate is suitable for the fourth fan 64.

The air suction port 52*a* is an operation positioned between the nip 101*b* and the transfer portion 12*a* and is provided toward the nip side. By such a constitution, the air suction port 52*a* is capable of receiving the dust D, as shown in FIG. 1, carried by the air flow F3 (FIG. 11).

The air discharge port 52*e* is provided in a side surface, of a plurality of side surfaces of the duct 52, which is on an outside of the air suction port 52*a* with respect to a longitudinal direction thereof and which is a side opposite from the air suction port 52*a*. As described above, the air discharge port 52*e* is connected to the fan air suction port 61*a*.

Further, on the duct 52, the filter 51 is mountable so as to cover the air suction port 52*a*. Specifically, the duct 52 is provided with an edge portion 52*c* of the air suction port 52*a* and ribs 52*b* each including a curved portion 52*d*. When the filter 51 is fixed to the duct 52 so as to be supported by the edge portion 52*c* and the ribs 52*b*, the air suction port 52*a* is covered with the filter 51. The filter 51 in this embodiment is bonded to the edge portion 52*c* and the ribs 52*b* with no gap by a heat-resistant adhesive. For that reason, the air passing through the air suction port 52*a* always passes through the filter 51.

Further, the filter 51 in this embodiment is bonded along the curved portions of the edge portion 52*c*. In other words, the duct 52 holds the filter 51 in a curved state. At this time, the filter 51 curves in a direction in which a central portion with respect to a widthwise (short length) direction thereof is spaced apart from the nip 101*b*. In other words, the filter 51 projects toward an inside of the duct 52 at the widthwise central portion thereof (4-1-1) Property of Filter The filter 51 is a filtering member for filtering (collecting, removing) the dust D from the air passing through the air suction port 52*a*. In the case where the dust D resulting from the wax is collected, the filter 51 may desirably be an electrostatic nonwoven fabric filter. The electrostatic nonwoven fabric filter is prepared by forming fibers holding static electricity in a nonwoven fabric shape, and is capable of filtering the dust D at high efficiency.

The electrostatic nonwoven fabric filter is high in filtering performance as the fibers have high density. This relationship is ditto for the case where a thickness of the electrostatic nonwoven fabric is made thick. Further, when charging strength (strength of the static electricity) of the fibers is made high, the filtering performance can be improved while maintaining pressure loss at a constant level. The thickness and fiber density of the electrostatic nonwoven fabric and the charging strength of the fibers may desirably be appropriately set depending on the filtering performance required for the filter.

As regards the electrostatic nonwoven fabric used for the filter 51, the fiber density, the thickness and the charging strength are set so that when a passing air speed is 10 cm/s, an air communication resistance is about 40 Pa and a collecting percentage is about 95%. Incidentally, in the case where the toner in the discharged air is intended to be filtered, the electrostatic nonwoven fabric is used with the air communication resistance of 10 Pa or less at the passing air speed of 10 cm/s. Accordingly, it can be said that the filter 51 in this embodiment uses the electrostatic nonwoven fabric which is relatively large in air communication resistance.

As regards the air communication resistance of the electrostatic nonwoven fabric, 30 Pa or more and 150 Pa or less at a passing air speed at which use of the filter is assumed (5 cm/s or more and 70 cm/s or less in this embodiment) is desirable. When the air communication resistance of the electrostatic nonwoven fabric is larger than 150 Pa, it is difficult to obtain a necessary air speed in an air discharging fan mountable in the printer 1. When the air communication resistance of the electrostatic nonwoven fabric is less than 30 Pa, as regards the air speed of the air passing through the filter 51, non-uniformity is liable to occur with respect to the longitudinal direction.

An amount per unit time of the air passing through the filter 51 becomes larger as the air speed of the air passing through the filter 51 is higher (faster). However, the air speed of the air passing through the filter 51 is higher, the temperature of the air in the neighborhood of the sheet inlet 400 is liable to make lower. For that reason, in the case where collecting efficiency of the dust D is enhanced, the air speed of the air passing through the filter 51 may desirably be an appropriate speed.

Specifically, the air speed of the air when the air passes through the filter 51 may desirably be 5 cm/s or more and 70 cm/s or less. In the constitution of this embodiment, the collecting percentage of the dust D in the filter 51 is approximately 100% at the air speed of 5 cm/s and is about 70% at the air speed of 70 cm/s. For that reason, when the air speed falls within this range, the dust D can be collected at high efficiency. Incidentally, the first fan 61 is capable of adjusting the air speed of the air passing through the filter 51 in a range from 5 cm/s to 70 cm/s.

(4-2-1) Dimension of Filter

The filter 51 has an elongated shape, as shown in part (a) of FIG. 2, such that a direction (direction along the longitudinal direction of the nip 101*b*) perpendicular to the sheet feeding direction is the longitudinal direction. By such a shape, the dust D generating in the neighborhood of the nip 101*b* can be reliably collected in a wide range with respect to the longitudinal direction.

A region shown by a hatched line on the sheet P of part (b) of FIG. 2 represents a region Wp-max in which the image is capable of being formed in the case where the sheet P with a predetermined width size is used. Incidentally, in actuality, the image is formed on a back-surface side of the sheet P seen in part (b) of FIG. 2. As shown in part (b) of FIG. 2, the region Wp-max is a region which is not more than the width wise of the sheet P. In this region, the toner image is formed on the sheet P, and in this region, the wax deposits on the sheet P, and the dust D generates in this region.

Incidentally, the fixing device 103 in this embodiment feeds the sheet P on the basis of a center of the belt 105 with respect to the widthwise direction (center(-line) basis feeding). For that reason, in order to collect the dust D efficiently, it is desirable that the dust D is reliably collected at least in this region. Accordingly, a dimension Wf of the filter 51 may desirably be longer than the region Wp-max in the sheet P with a minimum width size. Or, the dimension Wf may desirably be longer than the sheet P with the minimum-sheet size.

Further, the dust D is capable of generating in the region Wp-max on the maximum-width-size sheet P capable of being introduced into the fixing device 103. For that reason, in order to reliably collect the dust D, it is desirable to collect the dust D in an entire region of this region. Accordingly, the dimension Wf of the filter 51 may desirably longer than the region Wp-max in the maximum-width-size sheet P. Or, the dimension Wf of the filter 51 may desirably be longer than the maximum-width-size sheet P.

In the case where the printer 1 is capable of utilizing sheet P with a plurality of width sizes and in the case where the sheet P with a width size highest in frequency of use is known, in the width Wp-max of the sheet P thereof, it is desirable to satisfy Wf>Wp-max.

Incidentally, in this embodiment, a maximum size of the usable sheet is an A3 size, and a minimum size of the usable sheet is a post card size. The width of the sheet P with respect to the feeding direction is 297 mm for the A3 size and is 100 mm for the postcard size. Wp-max described above is a region excluding a blank region (non-image region) of 3 mm at each of end portions from the entire region of the sheet P with respect to the widthwise direction. For that reason, the width Wp-max on the A3-size sheet P is 291 mm (=297−3−3), and the width Wp-max of the post card-size sheet p is 94 mm (=100−3−3).

(4-1-3) Arrangement of Filter

The filter 51 is disposed in the neighborhood of the belt 105 as shown in FIG. 1. Further, the filter 51 is in a positional relationship such that the filter 51 opposes the (image surface of the) sheet P entering the fixing device 103. In the case where the collecting efficiency of the dust D is considered, the filter 51 may desirably be close to the nip

101*b* to the extent possible. However, the filter 51 and the belt 105 are caused to be excessively close to each other, there is a liability that the filter 51 is thermally deteriorated by radiation from the belt 105 and the filtering performance lowers. For that reason, the filter 51 may desirably be disposed in an appropriate distance relative to the nip 101*b*.

Specifically, an interval (shortest distance) between the filter 51 and the belt 105 may desirably be 5 mm or more. On the other hand, in order to reliably collect the dust D, the filter 51 may desirably be disposed within 100 mm on the basis of the nip 101*b*.

As described above, when the filter 51 is mounted on the air suction port 52*a* of the duct 52, there is no need to employ a constitution of guiding the air toward the filter 51. For that reason, the filter unit 50 can be downsized.

Further, as described above, when the filter 51 extending in the longitudinal direction is disposed in the neighborhood of the belt 105, the passing air speed of the air in the air suction port 52*a* of the duct 52 becomes uniform with respect to the longitudinal direction. In other words, by disposing the filter 51 which is the air communication resistor on the air suction port 52*a*, an entire region of a rear surface region of the filter 51 can be maintained at a certain negative pressure. That is, the negative pressures at points 53*a*, 53*b*, 53*c* shown in part (b) of FIG. 3 are substantially the same values.

This is because the air communication resistance of the filter 51 is considerably larger than the air communication resistance in the duct 52. When the negative pressures at the points 53*a*, 53*b* and 53*c* are at the same level, the air speed of air F4 sucked by the filter 51 is uniformized over the entire surface of the filter 51. As a result of uniformization of the air speed, the filter unit 50 is capable of collecting efficiently (at a minimum air flow rate) the dust D generating from the belt 105.

When the air suction amount by the filter unit 50 is small, an amount of the air flowing into the neighborhood of the belt 105 also becomes small. For that reason, a lowering in temperature in the neighborhood of the belt 105 can be made small. As a result, generation of the dust D can be suppressed, so that collection efficiency of the dust D is also improved. Further, the temperature lowering of the belt 105 is suppressed, and therefore it is also advantageous for energy saving.

(4-1-4) Shape of Filter

As described above, the central portion of the filter 51 with respect to the short length direction is curved in the direction in which the filter 51 is spaced away from the nip 101*b* (FIG. 1). In the case where such a curved surface shape is employed, a surface area of the filter 51 can be increased in a limited space. When the surface area of the filter 51 is increased, the collection efficiency of the dust D is improved.

(4-2) Air Flow Constitution

Next, an air flow in the printer 1 will be described. In the case where the dust D is efficiently collected, the air flow in the printer 1, particularly the air flow at a peripheral portion of the fixing device 103 may desirably be controlled appropriately. In the following, a constitution relating to the air flow at the peripheral portion of the fixing device 103 will be specifically described.

(4-2-1) First Fan

As described above, when the air flow rate of the first fan 61 which is the air sucking portion is large, the air can be sucked in a large amount, while the temperature of the air in the neighborhood of the sheet inlet 400 is liable to be lowered. The lowering in temperature of the air increases the overcooling degree ΔT and promotes the dust generation. For that reason, the air flow rate of the first fan 61 is needed to be appropriately set. The air flow rate from 20 L/min to 100 L/min is a proper range, and the printer 1 of this embodiment is set at 50 L/min (in air flow rate).

Incidentally, the filter 51 is deteriorated by sucking the dust D, paper powder generating from the sheet P and scattered toner scattering in a very small amount from the unfixed image on the sheet P during feeding. This is because deposition of the dust D, the paper powder and the scattered toner onto the filter 51 lowers the charging strength of the electrostatic nonwoven fabric which is the material of the filter 51. For that reason, the first fan 61 may desirably be at rest in the case where the dust D does not generate.

(4-2-2) Second Fan and Third Fan

When the sheet P containing water content is heated by the fixing device 103, water vapor generates from the sheet P. By this water vapor, a space C (FIG. 4) on a side downstream of the fixing device 103 with respect to the sheet feeding direction X is in a state in which humidity is high. When the humidity is high, dew condensation is liable to occur, and therefore, water droplets are liable to deposit on the guiding member 15. When the water droplets on the guiding member 15 deposit on the fed sheet P, an occurrence of an image defect is caused. For that reason, in the case where the humidity of the space C is increased by the water vapor generating from the sheet P, this humidity may desirably be lowered.

The second fan 62 is a fan for preventing the occurrence of the dew condensation on the guiding member 15. The second fan 62 sucks the air from the outside of the printer 1 and blows the air against the guiding member 15, and thus lowers the humidity of the space C.

Specifically, by the air blowing from the second fan 62, the water vapor in the neighborhood of the guiding member 15 diffuses to the peripheral portion of the space C, and therefore, local temperature rise in the neighborhood of the guiding member 15 is suppressed. Even in the case where only the second fan 62 is used, the dew condensation on the guiding member 15 can be suppressed to some extent.

However, designation of discharge of the water vapor is only a gap existing in the peripheral portion of the discharging roller pair 14, so that the humidity in the space C gradually increases. Therefore, in this embodiment, by the third fan 63, the humidity in the neighborhood of the guiding member 15 is discharged to the outside of the image forming apparatus.

(4-2-4) Fourth Fan

The fourth fan 64 which is the cooling air sucking portion has action of discharging hot air in a space between the fixing device 103 and the transfer portion 12*a* in order to prevent temperature rise in the neighborhood of the transfer portion 12*a*. When the temperatures of the transfer belt 10*c* and the secondary transfer roller 12 which constitute the transfer portion 12*a* excessively increase, the toner forming the unfixed image becomes soft and has the influence on the transfer process, and therefore, the fourth fan 64 discharges the hot air of the peripheral portion of these members. The air flow rate of the fourth fan 64 is set at about 500 L/min larger than 50 L/min of the first fan 61.

The suction port 42*a* of the cooling duct (heat discharging duct) 42 positions in the neighborhood of a longitudinal central portion of the belt 105 as shown in FIG. 1 and in part (a) of FIG. 2. In order to suck the hot air in an entire longitudinal region from the position, the suction port 42*a* is set so that the air flow rate becomes large. On the other hand, the fourth fan 64 has action of lowering the temperature in the peripheral space of the belt 105 and increasing the overcooling degree ΔT. The increase in overcooling degree ΔT leads to an increase in dust D, and therefore, the fourth fan 64 should be actuated only when the overcooling degree ΔT becomes sufficiently small.

Incidentally, when the overcooling degree ΔT is large, it is understood from the above-described formula (1) that the temperature of the peripheral portion of the belt 105 becomes low. For that reason, even if the fourth fan 64 is stopped when the overcooling degree ΔT is large, there is no problem.

(4-3) Control Flow

In this embodiment, by controlling the first fan 61 and the fourth fan 64 depending on the overcooling degree ΔT, while suppressing the generation of the dust D, the dust D is effectively removed by the filter 51, and deterioration of the filter 51 is prevented. Further, the temperature rise of the transfer portion 12*a* is also prevented.

In the following, operations of the first fan 61 and the fourth fan 64 will be described on the basis of FIG. 13 and FIG. 14. When a power source of the printer 1 is turned on (ON), the control circuit portion A executes a control program (S101). When the control circuit portion A receives a printer instruction signal, the control circuit portion A causes a step to go to S103 (S102). The control circuit portion A discriminates whether or not the following formulas (2) and (3) are satisfied (S103).

(Surface temperature *Tb* of belt 105)>*Tws*−20° C. formula (2)

(Dust generation temperature *Tws* of toner)−(spatial temperature *Ta* of measuring point *Tp*)>first temperature formula (3)

The formula (2) is a formula for discriminating whether or not the surface temperature at which the dust is capable of being generated. In part (a) of FIG. 14, when Ta falls in a range of an arrow A, the formula (2) is satisfied. Incidentally, here, in the formula (2), 20° C. is subtracted from Tws, but this is in consideration of a difference between the dust generation temperature in the measuring device of part (a) of FIG. 9 and the dust generation temperature in the fixing device 103.

The peripheral (ambient) temperature of the belt 105 lowers by sucking the peripheral air flow (air current) with rotation of the belt 105 as described above. The overcooling degree is increased by the temperature lowering, and therefore, the dust generates at a temperature 20° C. lower than the temperature in the device of part (a) of FIG. 9. In the formula (2), in order to rectify this phenomenon, 20° C. (adjusting temperature value Z° C.) is subtracted from Tws.

The formula (3) is a formula for discriminating whether or not the overcooling degree ΔT (=Tws−Ta) defined by the formula (1) satisfies an emission end condition of the dust. When this formula is satisfied, discrimination that there is no emission of the dust is made. In part (b) of FIG. 14, when ΔT falls in a range of an arrow B, the formula (3) is satisfied. As described above, the overcooling degree ΔT when 80% of a total generation amount of the dust D is emitted is 120.9° C., ΔT at the time of 90% emission is 116.4° C., and ΔT at the time of 100% emission is 109.5° C.

In this embodiment, actuations of the first fan 61 and the fourth fan 64 are switched when the emission of the dust D is completed by 100%, and therefore, the first temperature of the formula (3) is 109° C. However, in many cases, when the dust D is discharged by 80% or more, dust contamination of a component part such as the guiding member 15 can be sufficiently alleviated in many instances. For that reason, a first temperature as a threshold temperature may only be required to be appropriately set in a range of 109° C. or more and 121° C. or less in the case where the measuring point Tp is in a position of 6 mm from the belt (rotatable heating member) 105 toward the direction of the transfer portion (first position) 12*b*.

In the case where the formula (2) and the formula (3) described above are satisfied, a generation condition of the dust D is satisfied, so that the step goes to S104 and the first fan 61 is actuated. By the actuation of the first fan 61, the dust D can be removed immediately after a start of the printing. Incidentally, at this time, the fourth fan 64 becomes non-actuation (non-operation). This is because discharge of the dust D by the actuation of the fourth fan 64 without through the filter 51 is prevented.

Parts (a), (b) and (d) of FIG. 14 show that the formula (2) and the formula (3) are satisfied at the time of the start of the printing and that the first fan 61 is actuated. Incidentally, in the case where the formula (2) and the formula (3) are not satisfied, both the first fan 61 and the fourth fan 64 are non-actuation (S105).

Then, after the printing is started (S106), the control circuit portion A discriminates whether or not the following formula (4) is satisfied.

*Ta*≥second temperature formula (4)

The second temperature is set at 90° C. as shown in part (c) of FIG. 14. When Ta reaches this temperature, i.e., in the case where Ta enters a region of an arrow C in part (c) of FIG. 14 and satisfies the formula (4), the transfer portion 12*a* is regarded as being increased in temperature to the extent that the temperature increase has an adverse influence on the image formation. Then, the control circuit portion A causes, in addition to the fourth fan 64, the first fan 61 to actuate.

Although the first fan 61 is small in air flow rate compared with the fourth fan 64, the first fan 61 can suck the hot air in the entire longitudinal region of the belt 105, and therefore the cooling efficiency is high. By the actuation of the first fan 61, deterioration of the filter 51 advances, but in this embodiment, image quality maintenance is prioritized and the first fan 61 is actuated. In the case where the formula (4) is not satisfied in S107, the step goes to S109. Otherwise, the step goes to S108.

In S109, similar to S103, whether or not the formula (2) and the formula (3) are satisfied is discriminated. In the case of satisfaction, the case is regarded as that the dust D generates, and the first fan 61 is actuated. The fourth fan 64 is non-actuation (S110). In the case where the formula (2) and the formula (3) are not satisfied, the step goes to S111, and the first fan 61 is non-actuation and the fourth fan 64 is actuation, so that the hot air of the peripheral portion of the transfer portion 12*a* is discharged (S111).

During the printing, the formula (2) and the formula (3) are satisfied at the time when an elapsed time after the start of the printing reaches 207 sec in FIG. 14. In part (d) of FIG. 14, although the fourth fan 64 is actuated with Duty of 50% at the time of some lapse of 207 sec, this is because an increase in overcooling degree ΔT is suppressed. At the time (320 sec) when the overcooling degree ΔT sufficiently becomes small, the fourth fan 64 actuates at Duty of 100%.

After S110 and S111, whether or not a printing end condition is satisfied is discriminated (S112). In the case where the printing end condition is not satisfied, the step returns to S107, and discriminations of the formula (2), the formula (3) and the formula (4) are repeated. Otherwise, the printing is ended (S113).

The control of the above-described first fan 61 in this embodiment 1 is summarized as follows.

When a surface temperature of the belt (rotatable heating member) 105 is Tb (° C.), a dust generation temperature of the toner is Tws (° C.), and a spatial temperature detected by the temperature detecting means 67 is Ta (° C.), the control circuit portion A causes the first fan 61 to actuate at predetermined first efficiency in the case where the following condition formulas (1) and (2) are satisfied, and causes the first fan 61 to be non-actuation or to actuate at predetermined second efficiency lowered in efficiency than the predetermined first efficiency in the case where the condition formulas (1) and (2) are not satisfied.

$$Tb \geq Tws - Z \quad \text{formula (A)}$$

where Z is a preset adjusting temperature value (° C.), and $$Tws - Ta > \text{first temperature} \quad \text{formula (B)}$$

where the first temperature is a preset threshold temperature (° C.).

The printer 1 of this embodiment is capable of preventing the deterioration of the filter 51 by the above-described constitution and operation to suppress actuation of the first fan 61 while removing the dust D by the filter 51. That is, the dust generation is predicted, and by actuating the filter 51 only during the dust generation, lifetime elongation of the filter 51 can be realized. Further, the fourth fan 64 is actuated when the overcooling degree ΔT sufficiently becomes large and there is no dust generation, and therefore an effect of the filter 51 can be maximized.

(5) Other Matters

In the above, the present invention was described using the embodiment 1, but the present invention is not limited to the constitution described in embodiment 1. Numerical values such as the dimension exemplified in the embodiment are an example and may appropriately be set in a range in which the effect of the present invention is obtained. Further, within the range in which the effect of the present invention is obtained, a part of the constitution and control described in the embodiment may also be replaced with other constitutions and pieces of control which have similar functions.

For example, the temperature detecting means 67 may also be a temperature sensor provided at the measuring point Tp. The first temperature may also be deviated from the range from 109° C. to 121° C. In the case where the overcooling degree ΔT exceeds 121° C., dust emission is below 80%, but may only be required that the contamination of the guiding member 15 can be suppressed to a practically sufficient level. In the case where Ta and Tb do not satisfy the formula (2) and the formula (3), the first fan 61 may also be actuated at a low duty. In the case where Ta and Tb become satisfy the formula (2) and the formula (3), the duty of the fourth fan 64 is not increased stepwise, but may also be increased linearly.

Embodiment 2

As described in the embodiment 1, on the side upstream of the fixing device 103, the temperature increases when the printing progresses, so that the transfer portion 12*a* positioned on the side upstream of the fixing device 103 increases in temperature and the toner forming the unfixed image melts and has the influence on the transfer process. For that reason, the fourth fan (transfer portion cooling fan) 64 is provided and cools the side upstream of the fixing device 103. However, the side upstream of the fixing device 103 is cooled by the fourth fan 64, so that an environment in which the dust is liable to generate is formed.

Therefore, by controlling the operation of the fourth fan 64, the dust generation is suppressed, and further, an effect of the filter 51 for removing the dust can be increased.

That is, when a surface temperature of the belt (rotatable heating member) 105 is Tb (° C.), a dust generation temperature of the toner is Tws (° C.), and a spatial temperature detected by the temperature detecting means 67 is Ta (° C.), the control circuit portion A causes fourth fan (cooling fan) 64 to be non-actuation or to actuate at predetermined second efficiency lowered in efficiency from predetermined first efficiency in the case where the following condition formulas (A) and (B) are satisfied.

$$Tb \geq Tws - Z \quad \text{formula (A)}$$

where Z is a preset adjusting temperature value (° C.), and $$Tws - Ta > \text{first temperature} \quad \text{formula (B)}$$

where the first temperature is a preset threshold temperature (° C.).

The control circuit portion A causes the first fan (dust collecting fan) 61 to be non-actuation when Ta (° C.) and Tws (° C.) satisfy the following condition formulas (C) and (D). Or, the control circuit portion A causes the efficiency to actuate at predetermined second efficiency lowered in efficiency from predetermined first efficiency. At the same time, the control circuit portion A causes the fourth fan (cooling fan) 64 to actuate.

$$Tws - Ta \leq \text{first temperature} \quad \text{formula (C), and}$$

$$Ta \leq \text{second temperature} \quad \text{formula (D),}$$

where the second temperature is a preset threshold temperature lower than the first temperature.

When Ta (° C.) and Tws (° C.) satisfy, the following condition formulas (E) and (F), the control circuit portion A causes the first fan (dust collecting fan) 61 and the fourth fan (cooling fan) 64 to actuate.

$$Tws - Ta \leq \text{first temperature} \quad \text{formula (E)}$$

$$Ta > \text{second temperature} \quad \text{formula (F)}$$

A feature of this embodiment 2 is in that the operation of the fourth fan 64 is controlled by predicting the generation of the dust. By this, suppression of the dust generation and an increase in effect of the filter for removing the dust are realized. A hardware constitution and a software constitution of the printer 1 are similar to those of the embodiment 1 (all figures), and therefore, will be omitted from repetition description. . . .

Also in the printer 1 of this embodiment 2, similarly as in the embodiment 1, may also be replaced with other constitutions having similar functions. For example, the temperature detecting means 67 may also be a temperature sensor provided at the measuring point Tp. The first temperature may also be deviated from the range from 109° C. to 121° C. In the case where the overcooling degree ΔT exceeds 121° C., dust emission is below 80%, but may only be required that the contamination of the guiding member 15 can be suppressed to a practically sufficient level.

Other Embodiments

1) In the above, the embodiments of the present invention was described, but the constitution according to the present invention are not limited to the embodiments. For example, the fixing device 103 may also be a heating roller type or may also be a type utilizing electromagnetic induction heating.

2) In the embodiments, the fixing device in which the unfixed toner image is heat-fixed on the sheet was described as an example, but the present invention is not limited to this, and in order to improve glossiness (gloss) of the image, a device in which a toner image once fixed or temporarily fixed on the sheet is heated again may also be used. This case is also called the fixing device.

3) In the embodiments, as the image forming apparatus 1, a multi-function printer provided with a plurality of drums 6 was described. However, the present invention is also applicable to an image forming apparatus mounted in a monochromatic multi-function printer and a single-function printer which include a single drum 6.

4) Sheet feeding is not limited to the center basis feeding. The sheet feeding may also be one-side basis feeding.

INDUSTRIAL APPLICABILITY

According to the present invention, there is provided the image forming apparatus of which dust removing power is maintained for a long term.

The present invention is not limited to the above-described embodiments, but can be variously changed and modified without departing from the spirit and the scope of the present invention. Accordingly, the following claims are attached for making the scope of the present invention public.

The invention claimed is:

1. An image forming apparatus comprising:

an image forming portion configured to form a toner image on a recording material at a first position by using toner containing a parting agent;

a fixing portion configured to fix an unfixed toner image, at a second position, formed on the recording material by said image forming portion;

a heat discharging duct, including an inlet between the first position and the second position with respect to a recording material feeding direction, configured to discharge air heated by said fixing portion;

a heat discharging fan configured to generate an air flow in said heat discharging duct;

a collecting duct, including an inlet between the first position and the second position with respect to the recording material feeding direction;

a collecting fan configured to generate an air flow in said collecting duct;

a filter provided in said collecting duct to collect particles with a predetermined particle size resulting from the parting agent; and a controller configured to control operations of said heat discharging fan and said collecting fan, wherein said controller actuates said collecting fan while stopping the operation of said heat discharging fan in a case a temperature in a neighborhood of said fixing portion is a first temperature, and actuates said heat discharging fan while stopping the operation of said collecting fan in a case the temperature in the neighborhood of said fixing portion is a second temperature higher than the first temperature.

2. The image forming apparatus according to claim 1, wherein said controller actuates said collecting fan and said heat discharging fan in a case the temperature in the neighborhood of said fixing portion is a third temperature higher than the second temperature.

3. The image forming apparatus according to claim 1, wherein each of said heat discharging duct and said collecting duct is provided so as to face the unfixed toner image formed on the recording material.

4. The image forming apparatus according to claim 1, wherein said filter is an electrostatic nonwoven fabric filter.

5. The image forming apparatus according to claim 1, wherein said controller controls said collecting fan such that an air speed of the air when the air passes through said filter is 5 cm/s or more and 70 cm/s or less.

6. An image forming apparatus comprising:

an image forming portion configured to form a toner image on a recording material at a first position by using toner containing a parting agent;

a fixing portion including a rotatable heating member and a rotatable pressing member that fix the toner image, at a second position, fed from the first position by nipping and feeding the recording material through heat and pressure;

a duct provided with an air suction port between the first position and the second position;

a filter, provided on said duct, configured to collect dust resulting from the parting agent;

a fan configured to generate an air flow for sucking air into said duct;

a temperature detecting member configured to detect a spatial temperature in a neighborhood of said rotatable heating member; and a controller configured to control an operation of said fan, wherein, in a case a surface temperature of said rotatable heating member is Tb (° C.), a dust generation temperature of the toner is Tws (° C.), and the spatial temperature detected by said temperature detecting member is Ta (° C.), said controller (i) actuates said fan at a predetermined first efficiency in a case the following condition formulas (A) and (B) are satisfied and (ii) causes said fan to be in a non-actuation state or actuates said fan at a predetermined second efficiency when the following condition formulas (A) and (B) are not satisfied, the second efficiency being less efficient than the first efficiency:

condition formula (A) being $$Tb \geq Tws - Z,$$

where Z is a peripheral adjusting temperature value (° C.), and condition formula (B) being $$Tws - Ta > \text{a first temperature},$$

where the first temperature is a peripheral threshold temperature.

7. The image forming apparatus according to claim 6, wherein the spatial temperature Ta is the spatial temperature at a measuring point in a range of 1 mm or more and 20 mm or less from said rotatable heating member toward a direction of the first position.

8. The image forming apparatus according to claim 7, wherein said temperature detecting member is a temperature detecting device provided at the measuring point.

9. The image forming apparatus according to claim 7, wherein the first temperature falls within a range of 109° C. or more and 121° C. or less in a case that the measuring point is in a position that is 6 mm spaced from said rotatable heating member toward a direction of the first position.

10. The image forming apparatus according to claim 6, wherein said temperature detecting member predicts the spatial temperature Ta from an outside temperature of said image forming apparatus, an inside temperature of said image forming apparatus, and operation information on said fan for generating an air flow in a neighborhood of said rotatable heating member and said rotatable pressing member.

11. An image forming apparatus comprising:

an image forming portion configured to form a toner image on a recording material at a first position by using toner containing a parting agent;

a fixing portion including a rotatable heating member and a rotatable pressing member that fix the toner image, at a second position, fed from the first position by nipping and feeding the recording material through heat and pressure;

a cooling duct provided with an air suction port between the first position and the second position;

a cooling fan configured to generate an air flow for sucking air into said cooling duct;

a temperature detecting member configured to detect a spatial temperature in a neighborhood of said rotatable heating member; and a controller configured to control an operation of said cooling fan, wherein, in a case a surface temperature of said rotatable heating member is Tb (° C.), a dust generation temperature of the toner is Tws (° C.), and the spatial temperature detected by said temperature detecting member is Ta (° C.), said controller causes said cooling fan to be in a non-actuation state or actuates said cooling fan at a predetermined second efficiency that is less efficient than a first efficiency, when the following condition formulas (A) and (B) are satisfied:

condition formula (A) being $$Tb \geq Tws - Z,$$

where Z is a peripheral adjusting temperature value (° C.), and condition formula (B) being $$Tws - Ta > \text{a first temperature},$$

where the first temperature is a peripheral threshold temperature.

12. The image forming apparatus according to claim 11, further comprising:

a dust collecting duct including an air suction port between the first position and the second position;

a filter, provided on said dust collecting duct, for collecting dust resulting from the parting agent; and a dust collecting fan for generating an air flow for sucking the air into said dust collecting duct.

13. The image forming apparatus according to claim 12, wherein said controller causes said dust collecting fan to be in a non-actuation state or actuates said dust collecting fan at the second efficiency when the following condition formulas (C) and (D) are satisfied:

condition formula (C) being $$Tws - Ta \leq \text{the first temperature, and}$$

condition formula (D) being $$Ta \leq \text{a second temperature},$$

where the second temperature is a preset threshold temperature lower than the first temperature.

14. The image forming apparatus according to claim 12, wherein said controller actuates said dust collecting fan and said cooling fan in a case the spatial temperature Ta (° C.) and the dust generation temperature Tws (° C.) satisfy the following condition formulas (E) and (F):

condition formula (E) being $$Tws\ Ta \leq \text{the first temperature, and}$$

condition formula (F) being $$Ta > \text{a second temperature},$$

where the second temperature is a preset threshold temperature lower than the first temperature.

15. The image forming apparatus according to claim 11, wherein the spatial temperature Ta (° C.) is the spatial temperature at a measuring point in a range of 1 mm or more and 20 mm or less from the first position toward a direction of the second position.

16. The image forming apparatus according to claim 15, wherein said temperature detecting member is a temperature detecting device provided at said measuring point.

17. The image forming apparatus according to claim 15, wherein the first temperature falls within a range of 109° C. or more and 121° C. or less in a case that said measuring point is at a position that is 6 mm spaced from the first position toward a direction of the second position.

18. The image forming apparatus according to claim 11, wherein said temperature detecting member predicts the spatial temperature Ta from an outside temperature of said image forming apparatus, an inside temperature of said image forming apparatus, and operation information on said cooling fan for generating an air flow in a neighborhood of said rotatable heating member and said rotatable pressing member.

* * * * *